United States Patent [19]

Lelental et al.

[11] Patent Number: 4,727,008

[45] Date of Patent: Feb. 23, 1988

[54] DYE-FORMING ELECTRICALLY ACTIVATABLE RECORDING ELEMENT AND PROCESS

[75] Inventors: Mark Lelental, Penfield; Scott A. Brownstein, Irondequoit, both of N.Y.

[73] Assignee: Eastman Kodak Company, Rochester, N.Y.

[21] Appl. No.: 870,575

[22] Filed: Jun. 4, 1986

[51] Int. Cl.[4] ..... G03G 15/24; G03G 13/22

[52] U.S. Cl. ..... 430/42; 430/45; 430/351; 430/502; 430/629

[58] Field of Search ..... 430/42, 45, 46, 48, 430/52, 56, 60, 62, 66, 351, 502, 629

[56] References Cited

U.S. PATENT DOCUMENTS

| | | | |
|---|---|---|---|
| 4,131,463 | 12/1978 | Tsubol et al. | 204/4 |
| 4,201,591 | 5/1980 | Reithel | 430/619 |
| 4,234,670 | 11/1980 | Kaukeinen et al. | 430/52 |
| 4,284,704 | 8/1981 | Fleming et al. | 430/154 |
| 4,294,912 | 10/1981 | Adin et al. | 430/341 |
| 4,343,880 | 8/1982 | Lelental | 430/42 |
| 4,410,614 | 10/1983 | Lelental et al. | 430/48 |
| 4,435,490 | 3/1984 | Lelental et al. | 430/46 |

FOREIGN PATENT DOCUMENTS

| | | |
|---|---|---|
| 12855 | 7/1980 | European Pat. Off. . |
| 80/01322 | 6/1980 | World Int. Prop. O. . |

OTHER PUBLICATIONS

Research Disclosure, Dec. 1978, Item No. 17643.
Research Disclosure, Jul. 1986, Item No. 14719.

*Primary Examiner*—John L. Goodrow
*Attorney, Agent, or Firm*—Richard E. Knapp

[57] ABSTRACT

A dye-forming electrically activatable recording (EAR) element which is capable of forming at least two dye images comprises an electrically conductive support bearing on one side of the support at least a dye-forming layer (A) responsive to negative polarity charge exposure and at least one dye-forming layer (B) responsive to positive polarity charge exposure and, optionally, other dye-forming layers. A multicolor dye image can be formed in the dye-forming electrically activatable recording element by multistep imagewise charge exposure in which the exposure steps are reversed in electrical polarity at each step. The reversal of polarity of exposure at differing charge density levels enables formation of a dye image in at least one layer without formation of a dye image in another layer. Processing of the exposed dye-forming electrically activatable recording element is carried out by thermal processing or by means of processing solutions or baths.

20 Claims, 8 Drawing Figures

ELECTRICAL EXPOSURE LEVEL AND POLARITY FOR COUNTERPART COLOR

| | RED | GREEN | BLUE | BLACK | CYAN | MAGENTA | YELLOW |
|---|---|---|---|---|---|---|---|
| ELECTRICAL EXPOSURE POLARITY: | HIGH POSITIVE | LOW POSITIVE AND LOW NEGATIVE | HIGH NEGATIVE | HIGH POSITIVE AND LOW NEGATIVE | LOW NEGATIVE | | LOW POSITIVE |
| CYAN DYE FORMED | | • D | • D | • D | • D | | |
| MAGENTA DYE FORMED | (D) | | (D) | (D) | | | |
| YELLOW DYE FORMED | • D | • D | | • D | | | • D |

• = LATENT IMAGE
D = DYE FORMED
(D) = DYE FORMED BY INFECTIOUS DEVELOPMENT

FIG. 4

DYE-FORMING ELECTRICALLY ACTIVATABLE RECORDING ELEMENT AND PROCESS

BACKGROUND OF THE INVENTION

This invention relates to a dye-forming electrically activatable recording (EAR) process and element for such process capable of forming at least two dye images.

STATE OF THE ART

Dye-forming electrically activatable recording (EAR) processes and materials are known in the imaging art. These processes and materials involve an imagewise exposure to electric current of a dye-forming EAR element to form a developable image followed by formation of a dye image, typically by means of thermal development. Such processes and materials are described in, for example, U.S. Pat. No. 4,343,880.

While these processes and materials for dye-forming electrically activatable recording have advantages, such as room-light handleability, a problem that has been encountered centers on the capability of such materials and processes to form multicolor dye images. While such dye-forming EAR materials can form multicolor images, the materials have required overlay of layers after exposure and processing or coating of dye-forming EAR layers on opposite layers of an electrically conductive support with appropriate electrical imagewise exposure of each side. This involves expensive and complicated electrical exposure steps.

A continuing need has existed for a dye-forming EAR process and material enabling multilayer multicolor dye image formation without complicated electrical exposure steps or the need to coat EAR layers on opposite sides of an electrically conductive support.

SUMMARY OF THE INVENTION

It has been found that the described advantages according to the invention can be provided in a dye-forming electrically activatable recording process in which a multilayer dye-forming electrically activatable recording element is imagewise exposed in a multistep exposure to electrical current by applying different polarity in each step to form a developable image and then processed to form a dye image. The steps in the process according to the invention comprise (I) imagewise exposing the multilayer dye-forming EAR element to electrical charge of one polarity to form a developable latent image in at least one of the layers; then (II) imagewise exposing the multilayer dye-forming EAR element to electrical charge of a polarity opposite that from step (I) to form a developable latent image in another of the layers of the element; and then, (III) developing a dye image in the resulting exposed element.

The process according to the invention is useful for forming a multicolor image.

An illustrative process according to the invention of forming a dye image in a dye-forming EAR element comprising at least three electrically activatable image recording layers (A), (B) and (C) capable of forming dye images comprises the steps (I) imagewise exposing layer (A) to a positive polarity of charge exposure for a time sufficient to form a developable image in layer (A) without adversely affecting layers (B) and (C); then (II) imagewise exposing layer (C) to a negative polarity of charge exposure for a time sufficient to form a developable image in layer (C) without adversely affecting layers (A) and (B); and (III) processing the element for a time sufficient to form dye images in at least the layers (A) and (C). Such a process is useful for forming a multicolor image, such as an image wherein at least one of the layers comprises a cyan dye image, one of the layers comprises a magenta dye image, and another of the layers comprises a yellow dye image.

The described multilayer dye-forming EAR element typically comprises an electrically conductive support bearing (A) a dye-forming EAR layer, capable of forming a first dye image, particularly a yellow dye image, wherein the layer (A) comprises
  (i) a reducing agent or reducing agent precursor capable of being activated by a Lewis base,
  (ii) a cobalt(III) Lewis base complex, and
  (iii) a reducible dye that has an oxidation state above that of the conjugate dye, or a dye capable of changing its wavelength of absorption by reaction with a Lewis base to form a dye, particularly a yellow dye, or a dye-forming coupler capable of forming a dye, particularly a yellow dye, upon reaction with the oxidized form of the reducing agent;

(B) a dye-forming EAR layer, capable of forming a second dye image, particularly a magenta dye image, the layer (B) comprising
  (i) a reducing agent or reducing agent precursor capable of being activated by a Lewis base,
  (ii) a cobalt(III) Lewis base complex, and
  (iii) a reducible dye that has an oxidation state above that of the conjugate dye, or a dye capable of changing its wavelength of absorption by reaction with a Lewis base to form a dye, particularly a magenta dye, or a dye-forming coupler capable of forming a dye, particularly a magenta dye, upon reaction with the oxidized form of the reducing agent; and (C) a dye-forming EAR layer, capable of forming a third dye image, particularly a cyan dye image, comprising
  (i) a reducing agent or reducing agent precursor capable of being activated by a Lewis base,
  (ii) a cobalt(III) Lewis base complex, and
  (iii) a reducible dye that has an oxidation state above that of the conjugate dye, or a dye capable of changing its wavelength of absorption by reaction with a Lewis base to form a dye, particularly a cyan dye, or a dye-forming coupler capable of forming a dye, particularly a cyan dye, upon reaction with the oxidized form of the reducing agent.

A particularly useful dye-forming EAR element comprises an electrically conductive support bearing on the first side of the support, in sequence (A) a first dye-forming EAR layer comprising, in a binder,
  (i) a cobalt(III) amine complex,
  (ii) a dye-forming coupler (x) capable of oxidative coupling with the oxidized form of a color developing agent to form a cyan dye, and
  (iii) a color developing agent capable in oxidized form of reacting with the coupler (x);

(B) a first barrier layer, typically a polymeric acid barrier layer;

(C) a second dye-forming EAR layer comprising, in a binder, (i) a cobalt(III) amine complex, (ii) a dye-forming coupler (y) capable of oxidative coupling with the oxidized form of a color developing agent to form a magenta dye, and (iii) a color developing agent capable in oxidized form of reacting with the coupler (y) to form a magenta dye;

(D) a second barrier layer, typically a second polymeric acid barrier layer;

(E) a third dye-forming EAR layer comprising, in a binder, (i) a cobalt(III) amine complex, (ii) a dye-forming coupler (z) capable of oxidative coupling with the oxidized form of a color developing agent to form a yellow dye, and (iii) a color developing agent capable in oxidized form of reacting with the coupler (z); and (F) optionally, an overcoat layer; and, optionally, on the side of the support opposite to the first side G) a fourth dye-forming EAR layer comprising, in a binder, (i) a cobalt(III) amine complex, (ii) a dye-forming coupler (q) capable of oxidative coupling with the oxidized form of a color developing agent to form a black dye, and (iii) a color developing agent capable in oxidized form of a reacting with the coupler (q); and (H) an overcoat layer on (G). A process of forming a dye image in such an element comprises (I) imagewise exposing the layers on the first side of the support to an electrical current of one polarity of charge exposure to form a developable latent image in at least one of layers (A), (C) and (E); then (II) imagewise exposing the layers on the first side of the support to an electrical current of one polarity of charge exposure opposite of the polarity of step (I) to form a developable latent image in at least one of layers (A), (C) and (E) not comprising a developable latent image from step (I);

(III) imagewise exposing layer (G) to electrical current to form a developable latent image in layer (G); the step (III) being carried out before, during or after steps (I) and (III); and then (IV) developing a dye image in the resulting element.

If desired, at least a portion of the dye image from the processed element can be transferred to a dye image receiver which is integral with or separate from the EAR element. The transfer can be by thermal transfer or other means.

The EAR element is preferably a dye-forming electrothermographic recording (ETR) element which can be processed after electrical exposure by simply heating the exposed element. The exposed ETR element is heated at a temperature and for a time sufficient to form a dye image in at least one of the described layers.

The cobalt(III) Lewis base complex in the EAR element has the functions of enabling formation of a latent image upon electrical exposure of the EAR element and enabling release of a Lewis base upon processing of the element.

In the case of a dye-forming ETR element, the heating step in each of the described process embodiments is carried out at a temperature which enables release of the Lewis base from the cobalt(III) Lewis base complex and formation of the desired dye image, such as within the range of about 80° C. to about 200° C. typically at a temperature within the range of about 100° C. to about 180° C. until the desired dye image is formed.

The exact mechanism by which the latent image is formed in the EAR material by means of each polarity of charge exposure is not fully understood. Charge density levels of either positive or negative polarity of exposure can vary. Differing charge density levels means different exposure time and/or different voltage levels of exposure. It is postulated that the injection of a charge carrier due to the electric field into the combination of components in the dye-forming EAR element results in the formation of a developable latent image in at least one of the EAR layers. It is believed that the development of the latent image is accomplished by a reaction in which the latent image initiates the reaction of the described image-forming combination.

While a variety of image-recording combinations containing the described components can be useful, the optimum EAR combination and EAR element will depend upon such factors as the desired image, the particular image-forming combination, the source of exposing energy, processing condition ranges and the like.

The term "electrothermographic" recording (ETR) material herein means a material which, when subjected to a charge exposure undergoes a chemical and/or electrical change which provides a developable latent image that is developable by thermal processing.

The term "latent image" herein means an image that is not visible to the unaided eye or is faintly visible to the unaided eye and that is capable of amplification in a subsequent processing step.

The term "electrically conductive", such as in "electrically conductive support" herein means a support or layer that has a resistivity less than about $10^{-12}$ ohm/cm.

BRIEF DESCRIPTION OF THE DRAWINGS

FIG. 4 is an illustrative table indicating the electrical exposure level and polarity of electrical exposure to produce a counterpart color according to an illustrative embodiment of the invention.

DETAILED DESCRIPTION OF THE INVENTION

Figure 1:
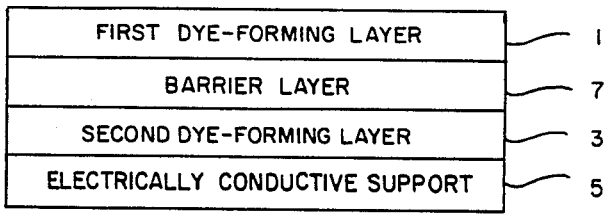
FIG. 1 schematically illustrates a dye-forming EAR element according to one illustrative embodiment of the invention.

In one illustrative process according to the invention a multicolor image is formed in a dye-forming EAR element. The element comprises in sequence an electrically activatable recording layer capable of forming a first dye image, particularly a cyan dye image, an EAR layer capable of forming a second dye image, particularly a magenta dye image, and an EAR layer capable of forming a third dye image, particularly a yellow dye image. The electrical exposure in the process is at a level and at a polarity which enables formation of a developable latent image in the first dye-forming layer and/or the third dye-forming layer. The dye image formed in the second dye-forming layer is formed by infectious development from either the first dye-forming layer or the third dye-forming layer after at least one of these layers is electrically exposed to a high level of electric charge, such as 10 millicoulombs/cm$^2$ to 10 coulombs/cm$^2$. The reversal of polarity in the electrical exposure steps of the process enables formation of a dye image in one of the dye-forming layers without formation of a dye image in other of the layers.

The term "infectious development" herein means formation of a dye image in a layer (z) that is not responsive to the level and time of electrical exposure of other layers of an EAR element but which is contiguous to or in a location sufficiently close to a layer (z) of an EAR element to enable formation of a dye image in the layer (z). It is postulated that a species of some type is transferred to layer (z) during electrical exposure or during processing that enables formation of the dye image in the layer (z). The transfer of this species enables infectious development.

Referring to the Figures that illustrate dye-forming EAR elements, preferably dye-forming ETR elements, and a process according to the invention, the dye-forming layers can comprise any dye-forming EAR composition that is capable of forming a dye image upon electrical exposure and processing. The dye-forming EAR layers typically comprise, in reactive association, (a) a reducing agent or reducing agent precursor capable of being activated by a Lewis base;
(b) a cobalt(III) Lewis base complex; and
(c) at least one of (i) a reducible dye-forming compound that has an oxidation state above that of the conjugate dye,
  (ii) a dye capable of changing its wavelength of absorption by reaction with a Lewis base, and
  (iii) a dye-forming coupler capable of oxidative coupling with the oxidized form of the reducing agent.

Reducing agents or reducing agent precursors in a dye-forming EAR element, typically an ETR element are capable of being activated by a Lewis base, particularly a Lewis base from the cobalt(III) Lewis base complex. The reducing agent or reducing agent precursor performs at least one of three functions in the EAR element upon electrical exposure and processing depending upon the composition of component (c). First, if component (c) is a reducible dye-forming compound that has an oxidation state above that of the conjugate dye, the reducing agent or the reducing agent formed from the reducing agent precursor causes the reducible dye-forming compound to be reduced enabling formation of a dye image. Second, if the component (c) is a dye capable of changing its wavelength of absorption the function of the reducing agent is to reduce the Co(III) complex with subsequent release of the Lewis base. Third, if component (c) is a coupler, then the reducing agent in oxidized form reacts with the coupler to form a dye.

The cobalt(III) Lewis base complex in the dye-forming EAR element has the functions of enabling formation of a latent image upon charge exposure of the dye-forming EAR element and enabling release of a Lewis base upon processing of the element.

The heating step in each of the described thermal process embodiments is carried out at a temperature which enables release of the Lewis base from the cobalt(III) Lewis base complex and formation of the desired dye image, such as within the range of about 80° C. to about 200° C., typically at a temperature within the range of about 100° C. to about 180° C., until the desired dye image is formed.

The processing step after charge exposure optionally can be carried out by means of processing solutions or baths. Such a processing step is typically carried out under ambient conditions of temperature and pressure. Processing can be carried out by means of processing solutions and baths known in the photographic art, such as described in "Modern Photographic Processing" by Grant Haist, Vol. 2, Chapters 9 and 10, John Wiley and Sons, Inc., N.Y., 1979 and *Research Disclosure,* November 1979, Item No. 18716 and *Research Disclosure,* December, 1978, Item No. 17643, Paragraph VII, published by Kenneth Mason Publications, Limited, Emsworth; Hampshire P010 7DD; England, in an article by W. T. Hanson and W. I. Kesener in the Journal of the Society of Motion Picture and Television Engineers, Vol. 61 (1953) pages 667–701, and U.S. Pat. No. 4,477,563, the descriptions of which are incorporated herein by reference.

While a variety of image recording combinations containing the described components can be useful, the optimum image recording combination and dye-forming EAR element will depend upon such factors as the desired image, the particular image-forming combination, the source of exposing energy, processing condition ranges and the like.

Any dye-forming compound in (c) (i) is useful if it is reducible by the reducing agent in the presence of the Lewis base released from component (b). Useful reducible dye-forming compounds for (c) (i) include, for example, tetrazolium or triazolium compounds which on reduction form formazan or azoamine dyes, respectively. A wide variety of such tetrazolium salts are known in the imaging art including bis-tetrazolium salts linked directly or through intervening divalent radicals in the 2 or 5 positions. Exemplary known tetrazolium salts are set forth in following Tables I, II and III. Additional exemplary tetrazolium salts are disclosed in Tables III, V and VI of U.S. Pat. No. 4,284,704, the disclosure of which are incorporated herein by reference.

TABLE I

| | Exemplary Dye-forming Tetrazolium Salts |
|---|---|
| T-1 | 2,3,5-triphenyl-2H—tetrazolium tetrafluoroborate |
| T-2 | 2-(2-bromophenyl)-3,5-diphenyl-2H—tetrazolium tetrafluoroborate |
| T-3 | 2-(2-trifluoromethylphenyl)-3,5-diphenyl-2H—tetrazolium tetrafluoroborate |
| T-4 | 2-(4-cyanophenyl)-3,5-diphenyl-2H—tetrazolium tetrafluoroborate |
| T-5 | 2-(3-nitrophenyl)-3,5-diphenyl-2H—tetrazolium tetrafluoroborate |
| T-6 | 2-(2,6-dimethylphenyl)-3,5-diphenyl-2H—tetrazolium tetrafluoroborate |

TABLE I-continued

| | Exemplary Dye-forming Tetrazolium Salts |
|---|---|
| T-7 | 2-(2,4-dichlorophenyl)-3,5-diphenyl-2H—tetrazolium tetrafluoroborate |
| T-8 | 2,3-di(2-chlorophenyl)-5-phenyl-2H—tetrazolium tetrafluoroborate |
| T-9 | 2-(4-nitrophenyl)-3-(4-methoxyphenyl)-5-phenyl-2H—tetrazolium tetrafluoroborate |
| T-10 | 2-(4-nitrophenyl)-3-phenyl-5-(3,4-dimethoxyphenyl)-2H—tetrazolium tetrafluoroborate |
| T-11 | 2-(2-methoxyphenyl)-3-phenyl-5-(4-nitrophenyl)-2H—tetrazolium tetrafluoroborate |
| T-12 | 2-(2-methyl-4-nitrophenyl)-3,5-diphenyl-2H—tetrazolium tetrafluoroborate |
| T-13 | 2-(2-chloro-4-nitrophenyl)-3,5-diphenyl-2H—tetrazolium tetrafluoroborate |
| T-14 | 2-(4-nitrophenyl)-3-(2,6-dimethylphenyl)-5-phenyl-2H—tetrazolium tetrafluoroborate |
| T-15 | 2-(4-nitrophenyl)-3-(4-iodophenyl)-5-phenyl-2H—tetrazolium hexafluorophosphate |
| T-16 | 2-(4-cyanophenyl)-3-(2,5-dichlorophenyl)-5-(4-methoxyphenyl)-2H—tetrazolium tetrafluoroborate |
| T-17 | 2,3-diphenyl-5-n-hexyl-2H—tetrazolium tetrafluoroborate |
| T-18 | 2,3-diphenyl-2H—tetrazolium tetrafluoroborate |
| T-19 | 2-(2-chloro-4-nitrophenyl)-3-phenyl-5-methyl-2H—tetrazolium tetrafluoroborate |
| T-20 | 2,3-diphenyl-5-(3,4-dimethoxyphenyl)-2H—tetrazolium tetrafluoroborate |
| T-21 | 2-(2-phenoxy-5-chlorophenyl)-3,5-diphenyl-2H—tetrazolium tetrafluoroborate |
| T-22 | 2-(2-methoxyphenyl)-3-phenyl-5-n-hexyl-2H—tetrazolium tetrafluoroborate |
| T-23 | 2-(4-nitrophenyl)-3-(2,4-dichlorophenyl)-5-(4-methoxyphenyl)-2H—tetrazolium tetrafluoroborate |
| T-24 | 2-(2-bromo-4-nitrophenyl)-3,5-diphenyl-2H—tetrazolium hexafluoroborate |
| T-25 | 2-(2-bromo-4-nitrophenyl)-3-phenyl-5-methyl-2H—tetrazolium tetrafluoroborate |
| T-26 | 2-(2-methyl-4-nitrophenyl)-3-phenyl-5-methyl-2H—tetrazolium tetrafluoroborate |
| T-27 | 2-(2-pyridyl)-3,5-di(4-chlorophenyl)-2H—tetrazolium hexafluorophosphate |
| T-28 | 2-(2-pyridyl)-3-(2,6-dimethylphenyl)-5-phenyl-2H—tetrazolium hexafluorophosphate |
| T-29 | 2-(2-iodophenyl)-3,5-diphenyl-2H—tetrazolium tetrafluoroborate |
| T-30 | 2-(4-trifluoromethylphenyl)-3,5-diphenyl-2H—tetrazolium tetrafluoroborate |

Other examples of such tetrazolium salts are described in U.S. Pat. No. 4,284,704, the disclosures of which are incorporated herein by reference. Particularly useful tetrazolium and triazolium compounds have two or three phenyl groups.

Particularly useful tetrazolium salts comprise any desired combination of 2, 3 and, optionally, 5 position aromatic or aromatic-like heterocyclic rings, such as phenyl, naphthyl, anthryl, quinolinyl, pyridyl, azolyl and the like. Azolyl rings include oxazolyl, thiazolyl, benzoxazolyl, benzothiazolyl and the like. These rings are optionally substituted. Examples of specific useful ring substitutents are alkyl, such as alkyl containing 1 to 6 carbon atoms; alkenyl, such as alkenyl containing 2 to 6 carbon atoms; alkynyl, such as alkynyl containing 2 to 6 carbon atoms; benzyl; styryl; phenyl; biphenylyl; naphthyl; alkoxy, such as methoxy and ethoxy; aryloxy, such as phenoxy; carboalkoxy, such as carbomethoxy and carboethoxy; carboaryloxy, such as carbophenoxy and carbonaphthoxy; acyloxy, such as acetoxy and benzoyloxy; acyl, such as acetyl and benzoyl; halogen, including fluoride, chloride, bromide and iodide; cyanide; azide; nitro; haloalkyl, such as trifluoromethyl and trifluoroethyl; amido, such as acetamido and benzamido; ammonia, such as trimethylammonia; azo, such as phenylazo; sulfonyl, such as methylsulfonyl; sulfonium, such as dimethyl sulfonium; silyl, such as trimethylsilyl and thioether, such as methylthio substituents.

Examples of useful tetrazolium salts having predominantly electronegative tetrazole nucleus substituents which provide useful dye stability are set forth in following Table II.

TABLE II

| | |
|---|---|
| T-43 | 2-(2-chlorophenyl)-3-phenyl-5-(3-nitrophenyl)-2H—tetrazolium tetrafluoroborate |
| T-44 | 2-(4-nitrophenyl)-3-(4-iodophenyl)-5-phenyl-2H—tetrazolium tetrafluoroborate |
| T-45 | 2-(4-nitrophenyl)-3-(3,6-dichlorophenyl)-5-phenyl-2H—tetrazolium tetrafluoroborate |
| T-46 | 2-(4-nitrophenyl)-3-(2,4,6-trichlorophenyl)-5-phenyl-2H—tetrazolium tetrafluoroborate |
| T-47 | 2-(2-nitrophenyl)-3-(2-bromophenyl)-5-phenyl-2H—tetrazolium tetrafluoroborate |
| T-48 | 2-(2-nitrophenyl)-3-phenyl-5-(4-chlorophenyl)-2H—tetrazolium tetrafluoroborate |
| T-49 | 2-(4-nitrophenyl)-3-phenyl-5-(4-chlorophenyl)-2H—tetrazolium tetrafluoroborate |
| T-50 | 2-(2,4-dichlorophenyl)-3-phenyl-5-(3-nitrophenyl)-2H—tetrazolium tetrafluoroborate |
| T-51 | 2-(2,4,5-trichlorophenyl)-3-phenyl-5-(4-nitrophenyl)-2H—tetrazolium tetrafluoroborate |
| T-52 | 2,5-di(4-nitrophenyl)-3-phenyl-2H—tetrazolium tetrafluoroborate |
| T-53 | 2,5-di(4-nitrophenyl)-3-phenyl-2H—tetrazolium tetrafluoroborate |
| T-54 | 2,3-di(4-nitrophenyl)-5-phenyl-2H—tetrazolium hexafluorophosphate |
| T-55 | 2,3-di(2,5-dichlorophenyl)-5-(4-methoxyphenyl)-2H—tetrazolium tetrafluoroborate |
| T-56 | 2-(2-chloro-5-nitrophenyl)-3-(2,5-dichloro phenyl)-5-(4-methoxyphenyl)-2H—tetrazolium hexafluorophosphate |
| T-57 | 2-(4-nitrophenyl)-3-(4-chlorophenyl)-5-phenyl-2H—tetrazolium tetrafluoroborate |
| T-58 | 2-(4-methylthiophenyl)-3-(3,5-dichlorophenyl)-5-(3-nitrophenyl)-2H—tetrazolium hexafluorophosphate |
| T-59 | 2-(4-bromo-1-naphthyl)-3-(4-cyanophenyl)-5-(3,4-dichlorophenyl)-2H—tetrazolium chloride |
| T-60 | 2-(2-trifluoromethyl-5-chlorophenyl)-3-(4-cyanophenyl)-5-phenyl-2H—tetrazolium bromide |
| T-61 | 2-(2-chloro-5-nitrophenyl)-3-(4-acetylphenyl)-5-(3-nitrophenyl)-2H—tetrazolium chloride |
| T-62 | 2-[4-(4-nitrophenylthio)phenyl]-3-(2-chloro-5-fluoromethylphenyl)-5-(3-nitrophenyl)-2H—tetrazolium bromide |
| T-63 | 2-(4-phenylsulfonylphenyl)-3-(2-chloro-4-cyanophenyl)-5-(3,4-dichlorophenyl)-2H—tetrazolium chloride |
| T-64 | 2-(2-biphenylyl)-3-(3,4-dichlorophenyl)-5-(4-cyanophenyl)-2H—tetrazolium chloride |
| T-65 | 2-(4-pyridyl)-3-(2,3,4,5,-tetrafluorophenyl)-5-phenyl-2H—tetrazolium hexafluorophosphate |
| T-66 | 2-(3-phenylformamidophenyl)-3-(2-nitro-4-chlorophenyl)-5-(3-chlorophenyl)-2H—tetrazolium tetrafluoroborate |

Any anion known to be useful in formazan dye-forming tetrazolium salts can be used in the described tetrazolium compounds. Preferred anions are those set forth in Tables I and II. Any one of these anions can be incorporated in place of any other anion in any of the tetrazolium salts set forth in Table I and II. Nonbasic, nonnucleophilic anions are preferred, such as tetrafluoroborate and hexafluorophosphate, for example. Such anions provide the resulting tetrazolium salt with enhanced protection against anion induced reduction, and for this reason their use is preferred. Such anions also provide against the premature activation of (a), the reducing agent or reducing agent precursor.

The formazan dyes formed may be chelated with various metal salts, such as those of iron, nickel, cobalt, copper, zinc, cadmium, chromium, titanium, molybdenum or tungsten. Such chelation can be useful to vary the color of the formazan dye or to stabilize it against fading.

It is believed that as the cobalt(III) complex as described is reduced to cobalt(II), releasing its Lewis base ligands. The cobalt(II) salt may chelate with the formazan dye to form a more stable dye image. Additional metal salts may be incorporated in the imaging element to chelate with and stabilize the formazan dye. All formazan dyes are capable of forming at least bidentate chelates. While distinct stabilization is observed for bidentate and tridentate formazan dye chelates, the use of tetrazolium salts that form tridentate chelates gives greater stabilization. Exemplary of tetrazolium salts capable of forming tridentate formazan dye chelates are those having one or more N-heterocyclic aromatic rings in the 2 or 3 positon, such as 2-pyridyl, 2-quinolinyl and 2-azolyl, such as 2-thiazolyl, 2-benzotriazolyl, 2-oxazolyl and 2-benzoxazolyl ring structures. Examples of tetrazolium salts for forming highly stable tridentate formazan dye chelates are set forth in Table III.

TABLE III

Exemplary Tetrazolium Salts for Forming Tridentate Formazan Dye Chelates

| | |
|---|---|
| T-73 | 2-(2-pyridyl)-3-(2,6-dimethylphenyl)-5-phenyl-1-2H—tetrazolium hexafluorophosphate |
| T-74 | 2-(2-pyridyl)-3,5-diphenyl-2H—tetrazolium bromide |
| T-75 | 2-(2-pyridyl)-3-(4-chlorophenyl)-5-phenyl-2H—tetrazolium nitrate |
| T-76 | 2,3-di(benzothiazol-2-yl)-5-dodecyl-2H—tetrazolium chloride |
| T-77 | 2,3-di(benzothiazol-2-yl)-5-cyano-2H—tetrazolium chloride |
| T-78 | 3-(4,5-dimethylthiazol-2-yl)-2,5-diphenyl-2H—tetrazolium bromide |
| T-79 | 2-(2-quinolinyl)-3-phenyl-5-(3-nitrophenyl)-2H—tetrazolium tetrafluoroborate |
| T-80 | 1,5-naphthalene-bis[3-[2-(2-pyridyl)-5-(3,4-dichlorophenyl)-2H—tetrazolium fluoroborate]] |
| T-81 | 3-(4,5-dimethylthiazol-2-yl)-2,5-diphenyl-2H—tetrazolium bromide |
| T-82 | 2-(2-quinolinyl)-3-phenyl-5-(3-nitrophenyl)-2H—tetrazolium tetrafluoroborate |
| T-83 | 1,5-naphthylenebis[3-[2-(2-pyridyl)-5-(3,4-dichlorophenyl)-2H—tetrazolium fluoroborate]] |
| T-84 | 2-(benzothiazol-2-yl)-3,5-di(4-chlorophenyl)-2H—tetrazolium chloride |
| T-85 | 2-(benzothiazol-2-yl)-3-(2-fluorophenyl)-5-(4-cyanophenyl)-2H—tetrazolium tetrafluoroborate |
| T-86 | 2-(benzothiazol-2-yl)-3-(4-chlorophenyl)-5-phenyl-2H—tetrazolium chloride |

The chelated formazan dyes are generally more absorptive in the red region of the spectrum than the corresponding unchelated formazan dyes. Thus, whereas formazan dyes generally tend toward red images, chelated formazan dyes are considerably bluer, producing darker images.

The formazan dye images produced can, if desired, be stabilized either by addig electronegative substituents to the tetrazole nucleus or by incorporating metal salts in combination with the tetrazolium salts. If desired, these two stabilization techniques can be used in combination. For example, the tetrazolium salts T-37 and T-41 are sufficiently electronegative in their tetrazole nucleus substituents to constitute particularly useful tetrazolium salts in terms of stability, even without chelation. These tetrazolium salts can be useful to produce formazan dyes of even greater stability by forming tridentate chelates.

Triazolium salts are also useful as reducible dye-forming compound (c) (i).

Particularly useful triazolium salts are those having an aromatic ring fused with the triazole nucleus. Although many triazolium salts are useful, such triazolium salts produce azoamine dyes of increased density as compared to triazolium salts lacking a fused aromatic ring. Further, these latter triazolium salts typically produce azoamine dyes of a yellow hue, whereas triazolium salts containing an aromatic ring fused with the triazole nucleus are typically either shifted toward the red portion of the spectrum or more neutral in hue.

Examples of useful ring substituents and the triazolium salts they form are set forth in the above-referenced U.S. Pat. No. 4,284,704 and in following Table IV. To enhance the stability of the azoamine dyes produced, it is preferred to incorporate predominantly electronegative substituents in the triazolium salts.

Any anion known to be useful in azoamine dye-forming trazolium salts is useful. Any one of these anions can be incorporated in place of any other anion in any of the triazolium salts set forth in Table IV. Nonbasic, nonnucleophilic anions are preferred, such as tetrafluoroborate and hexafluorophosphate, for example. Such anions provide the resulting triazolium salt with enhanced protection against anion induced reduction. Such anions also provide against the premature activation of (a), the reducing agent or reducing agent precursor.

Azoamine dyes formed by reduction of triazolium salts may be stabilized and have their colors influenced by chelating with metal salts. These dyes may be chelatable with the reduced cobalt complex to increase their stability. Metal salts as described in relation to formazan dye chelates may be used to provide chelation of the azoamine dyes. All azoamine dyes are capable of forming at least bidentate chelates. While distinct stabilization can be achieved with bidentate and tridentate chelates, the use of triazolium salts that form tridentate chelates gives greater stabilization. Exemplary triazolium salts capable of forming tridentate azoamine dye chelates are those having one or more N-heterocyclic aromatic rings in the 1 or 2 position, such as 2-pyridyl and 2-azolyl, such as 2-triazolyl, 2-benzothiazolyl, 2-oxazolyl and 2-benzoxazolyl ring structures.

Examples of particularly useful triazolium salts are set forth below in following Table IV.

TABLE IV

Triazolium Salts for Forming Azoamine Dyes

| | |
|---|---|
| Tr-1 | 1-methyl-2-phenyl-2H—1,2,3-triazolium tetrafluoroborate |
| Tr-2 | 1-neopentyl-2-phenyl-2H—1,2,3-triazolium iodide |
| Tr-3 | 1-(n-butyl)-2-phenyl-6-nitro-2H—benzo-1,2,3-triazolium iodide |
| Tr-4 | 2-phenyl-3-(pyrid-2-yl)-2H—naphtho-[1,2-d]-1,2,3-triazolium perchlorate |
| Tr-5 | 2-(4-carbomethoxyphenyl)-3-phenyl-2H—naphtho-[1,2-d]-1,2,3-triazolium hexafluorophosphate |
| Tr-6 | 2-(4-cyano-1-naphthyl)-3-phenyl-2H—naphtho-[1,2-d]-1,2,3-triazolium tetrafluoroborate |
| Tr-7 | 2-(1-nitro-2-naphthyl)-3-phenyl-2H—naphtho-[1,2-d]-1,2,3-triazolium tetrafluoroborate |
| Tr-8 | 2,3-diphenyl-5-phenoxy-2H—naphtho[1,2-d]-1,2,3-triazolium nitrate |
| Tr-9 | 2,2'-(p-phenylene)bis(3-phenyl-2H—naphtho-[1,2-d]-1,2,3-triazolium hexafluorophosphate) |
| Tr-10 | 2,2'-(2-chloro-1,4-phenylene)bis(3-phenyl-2H—naphtho[1,2-d]-1,2,3-triazolium hexafluorophosphate) |
| Tr-11 | 2,2'-(1,5-naphthylene)bis(3-phenyl-2H— |

TABLE IV-continued

| Triazolium Salts for Forming Azoamine Dyes | |
|---|---|
| | naphtho[1,2-d]-1,2,3-triazolium hexafluorophosphate) |
| Tr-12 | 2,3-di(4-methoxyphenyl)-5-nitro-2H—naphtho-[1,2-d]-1,2,3-triazolium bromide |

The reducible dye-forming compound (c) (i) is useful in a dye-forming EAR element in any concentration that enables the desired dye-forming reaction upon processing. The EAR layer generally contains the reducible dye-forming compound (c) (i) or combination of such compounds within the range of 0.1 to 10 mole of dye-forming compound (c) (i) per mole of Co(III) complex in the recording layer. Selection of an optimum concentration of reducible dye-forming compound (c) (i) will depend upon such factors as the particular components of the dye-forming EAR element, the desired image, processing conditions, and the particular reducible dye-forming compound (c) (i).

Any dye that is capable of changing its wavelength of absorption by reaction with a Lewis base is useful as component (c) (ii) in a dye-forming EAR element as described. The component (c) (ii) can be a dye that changes its wavelength of absorption from a first wavelength prior to electrical exposure of the element to any second wavelength of absorption after electrical exposure and processing of the dye-forming EAR element. Examples of such useful component (c) (ii) are 2,4-diphenyl-6-(β-methyl-3,4-diethoxystyryl)pyrylium tetrafluoroborate and ethyl red dye.

The dye (c) (ii) that is capable of changing its wavelength of absorption by reaction with a Lewis base is useful in a dye-forming EAR element in any concentration that enables the desired dye-forming reaction upon processing. The EAR layer generally contains the dye (c) (ii) or a combination of such dyes within the range of 0.1 to 10 mole of dye (c) (ii) per mole of Co(III) complex in the EAR layer. Selection of an optimum concentration of dye (c) (ii) will depend upon such factors as the particular components of the dye-forming EAR element, the desired image, processing conditions, and the particular dye (c) (ii).

Any dye-forming coupler is useful in the dye-forming EAR element and process, as described, in component (c) (iii) provided the coupler forms a dye upon oxidative coupling with the reducing agent or reducing agent formed from the reducing agent precursor in component (a) upon electrical exposure and processing of the dye-forming EAR element. The dye-forming coupler herein means a compound or combination of compounds which, with other of the described components, upon oxidative coupling produces a desired dye image upon heating the recording layer after electrical exposure. These are designated as dye-forming couplers because it is believed that the compounds couple with the oxidized reducing agent to produce the desired dye. The dye-forming couplers described herein are also known in the photographic art as color-forming couplers. Combinations of dye-forming couplers are useful. Selection of an optimum dye-forming coupler or coupler combination will be influenced by such factors as the desired dye image, other components of the recording layer, processing conditions, particular reducing agent in the recording layer and the like. An example of a useful magenta dye-forming coupler is 1-(2,4,6-trichlorophenyl)-3-{3-[α-(3-pentadecylphenoxy)-butyramido]benzamido}-5-pyrazolone. A useful cyan dye-forming coupler is 2,4-dichloro-1-naphthol. A useful yellow dye-forming coupler is α-{3-[α-(2,4-di-tertiary-amylphenoxy)acetamido]benzoyl}-2-fluoroacetanilide. Useful cyan, magenta and yellow dye-forming couplers are selected from those known in the photographic art such as described in, for example, "Neblette's Handbook of Photography and Reprography", edited by John M. Sturge, Seventh Edition, 1977, pages 120 and 121, and *Research Disclosure*, Vol. 176, December 1978, Item 17643, paragraphs VII C–G.

Other examples of useful dye-forming couplers are as follows:

Couplers which form cyan dyes upon reaction with the ozidized form of a described reducing agent, especially a color developing agent, are described in such representative patents and publications as U.S. Pat. Nos. 2,772,162; 2,895,826; 3,002,836; 3,034,892; 2,474,293; 2,423,730; 2,367,531; 3,041,236; and 4,248,962. Preferably such couplers are phenols and naphthols which form cyan dyes on reaction with oxidized color developing agent in the presence of a Lewis base in the dye-forming EAR exposed element upon processing. Structures of examples of such couplers are:

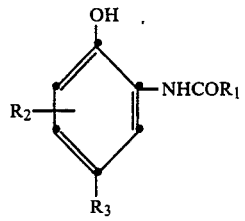

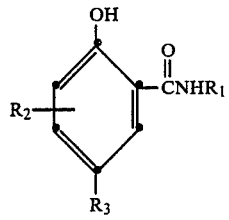

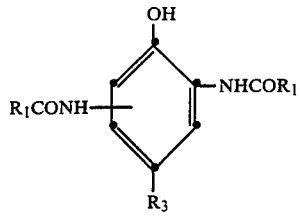

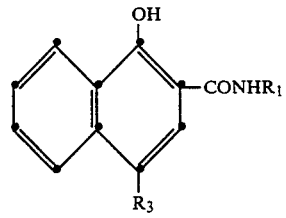

wherein:

$R_1$ represents a ballast group;

$R_2$ represents one or more halogen, such as chlorine or fluorine, alkyl, such as alkyl containing 1 to 4 carbon atoms, for example methyl, ethyl, propyl and butyl; or alkoxy, such as alkoxy containing 1 to 4 carbon atoms, for example methoxy, ethoxy, propoxy and butoxy; and, $R_3$ is hydrogen or a coupling-off group, that is a group capable of being released upon reaction of the oxidized form of the reducing agent with the coupler.

Couplers which form magenta dyes upon reaction with the oxidized form of a described reducing agent, especially a color developing agent, are described in such representative patents as U.S. Pat. Nos. 2,600,788; 2,369,489; 2,343,703; 2,311,082; 3,152,896; 3,519,429; 3,062,653; 2,908,573; and 4,248,962. Preferably such couplers are pyrazolones, pyrazoloimidazoles and pyrazolotriazoles which form magenta dyes upon reaction with oxidized form of the described reducing agent, especially a color developing agent. Structures of examples of such couplers are:

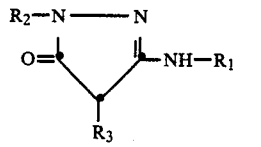

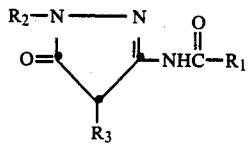

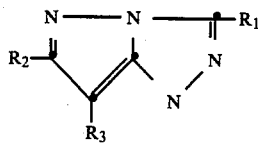

wherein:

$R_1$ and $R_3$ are as defined above; and $R_2$ is as defined above or is phenyl or substituted phenyl, such as 2,4,6-trichlorophenyl.

Couplers which form yellow dyes upon reaction with the oxidized form of a described reducing agent, especially a color developing agent, are described in such representative patents as U.S. Pat. Nos. 2,875,057; 2,407,210; 3,265,506; 2,298,443; 3,048,194; 3,447,928; and 4,248,962. Preferably such yellow dye-forming couplers are acylacetamides, such as benzoylacetanilides and pivalylacetanilides. Structures of examples of such yellow-dye forming couplers are:

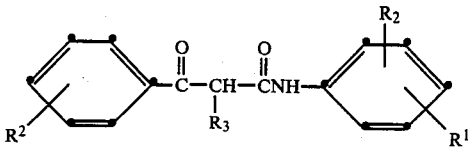

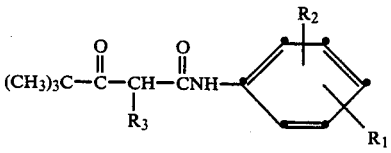

wherein:

$R_1$ and $R_3$ are as defined above;

$R_2$ is hydrogen; one or more halogen, such as chlorine or bromine; alkyl, such as alkyl containing 1 to 4 carbon atoms, for example methyl, ethyl, propyl or butyl; or a ballast group, such as an alkoxy group containing 16 to 20 carbon atoms or an alkyl group containing 12 to 30 carbon atoms.

Couplers which form black dyes upon reaction with the oxidized form of a described reducing agent, especially a color developing agent, are described in such representative patents as U.S. Pat. Nos. 1,939,231; 2,181,944; 2,333,106; 4,126,461; 4,429,035; and 4,200,466. Preferably such black dye-forming couplers are resorcinolic couplers or m-aminophenol couplers. Structures of examples of such black dye-forming couplers are:

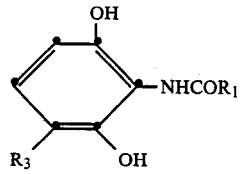

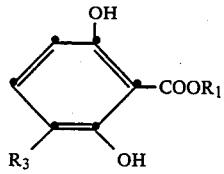

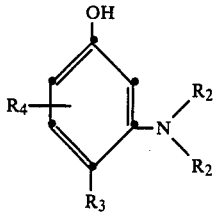

wherein:

$R_1$ is alkyl containing 3 to 20 carbon atoms, phenyl, or phenyl substituted with hydroxy, halo, amino, alkyl of 1 to 20 carbon atoms, or alkoxy of 1 to 20 carbon atoms;

each $R_2$ is independently hydrogen, halogen, alkyl, such as alkyl of 1 to 20 carbon atoms, alkenyl, such as alkenyl of 1 to 20 carbon atoms, or aryl, such as aryl of 6 to 20 carbon atoms;

$R_3$ is hydrogen or a coupling-off group;

$R_4$ is one or more halogen, alkyl, such as alkyl of 1 to 20 carbon atoms, alkoxy, such as alkoxy of 1 to 20 carbon atoms, or other monovalent organic groups that do not adversely affect coupling activity of the described couplers.

An example of a coupler that is particularly useful is 2-acetamidoresorcinol.

When the dye-forming EAR element, typically a dye-forming ETR element, comprises a coupler, the coupler can comprise a timing group (TIME) which is displaced from the coupler as a result of reaction of the coupler with the oxidized form of the reducing agent, particularly the oxidized form of a color developing agent, and thereafter undergo a reaction, such as an intramolecular nucleophilic displacement reaction, to release a useful group (RUG). The coupler can comprise a timing group between the coupler moiety and the useful group, so that the reaction of the coupler with the oxidized form of the reducing agent, especially the oxidized form of a color developing agent, cleaves the bond between the timing group and the coupler and then cleaves the bond between the useful group and the timing group.

Couplers which comprise a timing group and a releasable useful group are represented by the structure:

COUP-TIME-RUG wherein:

COUP is a coupler moiety;

TIME is a timing group; and

RUG is a releasable useful group.

The COUP can be any coupler moiety that will react with the oxidized form of the reducing agent, especially the oxidized form of a color developing agent, to release TIME-RUG. The COUP includes coupler moieties known to be useful in the photographic art. The TIME group also can be any timing group which is capable of being released upon reaction of COUP with the oxidized form of the reducing agent. The TIME group can be any of those TIME groups known to be useful with couplers in the photographic art, such as described in U.S. Pat. Nos. 4,248,962 and 4,409,323. The releasable useful group (RUG) can be any useful group which can be released during processing of the dye-forming EAR element and which aids in providing a useful dye image.

Herein the terms "coupler" and "coupler compound" refer to the entire compound, including the coupler moiety, any timing group and any useful group bonded directly or indirectly to the coupler moiety. The term "coupler moiety" herein refers to that portion of the coupler other than a timing group, if any, and other useful group.

In the case of a coupler, the coupler moiety can be unballasted or ballasted in order to maintain its location in the dye-forming EAR element. The coupler can be a monomeric, oligomeric or polymeric coupler or combinations of such couplers. Combinations of couplers are particularly useful.

The product formed upon processing of the dye-forming EAR element can be: (1) colored and nondiffusible; (2) colored and diffusible; or (3) colorless and diffusible or nondiffusible, in which case it will not contribute to image density. In cases (2) and (3) the reaction product may be initially colored and/or nondiffusible but converted to colorless and/or diffusible products during processing. In case (3) the reaction product may be converted to colored and diffusible or nondiffusible by reaction with another component in the dye-forming EAR element or in a contiguous image receiver optionally present.

The RUG can be any group that is desirably made available in the dye-forming element, preferably in an imagewise fashion. The RUG can be a dye or a reagent which upon release further reacts with components in the element, such as a development inhibitor, a development accelerator, a coupler, such as a competing coupler, a dye-forming coupler, a DIR coupler, a developing agent, such as a competing developing agent, a toner, a hardener, a tanning agent, a fogging agent, an antifoggant, a chemical or spectral sensitizer and a desensitizer.

The couplers which release a dye or dye precursor can be used in processes where the dye is allowed to diffuse to an integral or separate receiving layer to form a desired image. Alternatively, the dye can be retained in the location where it is released to augment the density of the dye formed from the coupler from which it is released or to modify or correct the hue of that dye or another dye. In another embodiment, the dye can be completely removed from the element and the dye which was not released from the coupler can be retained in the EAR element as a color correcting mask.

The dye-forming coupler or coupler combination is useful in a range of concentrations in the described recording layers. The recording layers generally contain a concentration of dye-forming coupler that is within the range of about 0.1 to about 10 mole of the dye-forming coupler per mole of the reducing agent or reducing agent precursor in the recording layer. An especially useful concentration of dye-forming coupler is within the range of about 0.5 to about 2.0 mole of dye-forming coupler per mole of reducing agent or reducing agent precursor in the recording layer.

Selection of an optimum concentration of dye-forming coupler will depend upon such factors as the particular coupler, the desired image, processing conditions, and other components in the EAR layer.

Any cobalt(III) Lewis base complex is useful as component (b). The component (b) upon electrical exposure enables or aids in formation of a latent image in the dye-forming EAR element and upon processing of the exposed dye-forming EAR element releases a Lewis base. A Lewis base herein is used in the same context as in organic chemistry textbooks, such as C. R. Noller, "The Chemistry of Organic Compounds" 2nd Ed., W. B. Saunders Company, Phila. and London (1958) p. 236.

Such cobalt(III) complex image forming materials are known in the imaging art and are described in, for example, *Research Disclosure,* Vol. 168, Item No. 16845; *Research Disclosure,* Vol. 126, Item No. 12617; *Research Disclosure,* Vol. 185, Item No. 18535; *Research Disclosure,* Vol. 158, Item No. 15874; *Research Disclosure,* Vol. 184, Item No. 18436; U.S. Pat. No. 4,273,860; U.K. published Application No. 2,012,445A; European Pat. No. 12,855; and published application WO No. 80/01322, the disclosures of which are incorporated herein by reference.

Preferred cobalt(III) complexes feature a molecule having a cobalt atom or ion surrounded by a group of atoms, ions or other molecules which are generically referred to as ligands. The cobalt atom or ion in the center of these complexes is a Lewis acid while the ligands are Lewis bases. Trivalent cobalt complexes, that is cobalt(III) complexes, are used because the ligands are relatively tenaciously held in these complexes and released when the cobalt is reduced to the (II) state.

Silver salts, although not necessary, are useful in a dye-forming EAR element as described. Many organic silver salt oxidizing agents are useful in the described image-forming combination in the recording layer. The organic silver salt oxidizing agent is typically resistant to darkening upon illumination. One class of useful silver salt oxidizing agents is represented by the silver salts of long-chain fatty acids which are stable to light. The term "long-chain", as used herein, is intended to mean a chain of carbon atoms containing 10 to 30 carbon atoms. Compounds within this class which are useful include silver behenate, silver stearate, silver oleate, silver laurate, silver hydroxystearate, silver caprate, silver myristate and silver palmitate.

Any reducing agent or reducing agent precursor is useful as component (a) that is capable of being activated by a Lewis base and enables the Co(III) complex to be reduced and the desired dye image to be formed. Selection of an optimum reducing agent or reducing agent precursor will depend upon the particular components of the dye-forming EAR element, particularly components (b) and (c), as well as the processing conditions.

Any reducing agents or reducing agent precursors which, in their oxidized form, form a dye with the described dye-forming coupler are useful in the dye-forming EAR element according to the invention. The reducing agent is typically an organic silver halide color developing agent. Combinations of reducing agents are useful. It is important that the reducing agent produce an oxidized form which can react under the processing conditions with the described dye-forming coupler to produce a desired dye. Especially useful reducing agents are primary aromatic amines including, for example, paraphenylenediamines. Examples of useful reducing agents which are primary aromatic amines include n-aminophenol-2,6-dichloro-4-aminophenol
4-amino-N,N-dimethylaniline;
4-amino-N,N-diethylaniline;
4-amino-3-methyl-N,N-diethylaniline (also known as N,N-diethyl-3-methyl-paraphenylenediamine);
4-amino-N-ethyl-N-β-hydroxyethylaniline;
4-amino-3-methyl-N-ethyl-N-β-hydroxyethylaniline;
4-amino-3-methoxy-N-ethyl-N-β-hydroxyethylaniline;
4-amino-N-butyl-N-gamma-sulfobutylaniline;
4-amino-3-methyl-N-ethyl-N-β-sulfoethylaniline;
4-amino-3-β-(methanesulfonamido)ethyl-N,N-diethylaniline;
4-amino-3-β-(methanesulfonamido)ethylaniline;
2-amino-3-methyl-N-ethyl-N-β-methoxyethylaniline and the like. Salts of these amines are also useful such as the hydrochlorides or hydrotetrafluoroborates.

Other useful reducing agents or reducing agent precursors are sulfonylhydrazones.

The described reducing agent is useful in a range of concentrations in the dye-forming EAR element according to the invention. Selection of an optimum concentration of reducing agent or combination of reducing agents will depend upon the described factors including the desired image, the other components in the dye-forming EAR element, processing conditions and the like. A useful concentration of reducing agent or combination of reducing agents is within the range of about 0.1 to about 10 moles of reducing agent per mole of Co(III) complex in the recording layer as described. An especially useful concentration of reducing agent is within the range of about 0.2 to about 2 moles of reducing agent per mole of Co(III) complex in the dye-forming EAR layer.

The dye-forming EAR element according to the invention need not, but typically does, comprise a separate binder. The dye-forming EAR element typically comprises a variety of colloids and polymers alone or in combination as vehicles and binding agents. These vehicles and binding agents are in various layers of the element, especially in the dye-forming EAR layers. Useful materials are hydrophobic or hydrophilic. It is necessary, however, that the vehicle or binder in the element not adversely affect the charge sensitivity or ohmic resistivity of the element of the invention. Accordingly, the selection of an optimum colloid or polymer, or combination of colloids or polymers, depends upon such factors as the desired charge sensitivity, desired ohmic resistivity, particular polymer, particular components in the layers, desired image and particular processing conditions. Useful colloids and polymers are transparent or translucent and include both naturally occurring substances, such as proteins, for example, gelatin, gelatin derivatives, cellulose derivatives, polysaccharides, such as dextran, gum arabic and the like. Synthetic polymers, however, are preferred, due to their desired charge sensitivity properties and ohmic resistivity properties. Useful polymeric materials for this purpose include polyvinyl compounds, such as poly(vinyl pyrrolidone), acrylamide polymers and dispersed vinyl compounds, such as in latex form. Effective polymers include water insoluble polymers of alkyl acrylates and methacrylates, acrylic acid, sulfoalkyl acrylates, methacrylates and those which have cross-linking sites which facilitate hardening or curing. Especially useful polymers are high molecular weight materials and resins which are compatible with the described components of the dye-forming EAR element. These include, for example, poly(vinyl butyral), cellulose acetate butyrate, poly(methyl methacrylate), poly(vinyl pyrrolidone), ethyl cellulose, polystyrene, poly(vinyl chloride), poly(isobutylene), butadiene-styrene copolymers, vinyl chloride-vinyl acetate copolymers, copolymers of vinyl acetate, vinyl chloride and maleic acid and poly(vinyl alcohol). Combinations of colloids and polymers are also useful, depending upon the described factors. Preferred binders include cellulose esters such as cellulose acetate butyrate and acrylic esters such as poly(methyl methacrylate).

Another illustrative group of useful polymeric binders in a dye-forming EAR element, particularly a dye-forming ETR element, as described is represented by the formula:

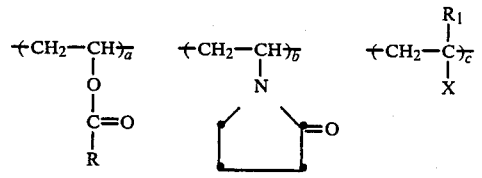

wherein:

R is alkyl, such as alkyl containing 1 to 10 carbon atoms, for example methyl, ethyl, propyl, butyl, and decyl; aryl, such as aryl containing 6 to 10 carbon atoms, for example phenyl and naphthyl; or aralkyl, such as aralkyl containing 7 to 15 carbon atoms, for example benzyl and phenethyl;

$R_1$ is hydrogen or methyl;

a is 99 to 50 weight percent;

b is 50 to 1 weight percent;

c is 0 to 15 weight percent;

X is aryl, such as aryl containing 6 to 12 carbon atoms, for example phenyl, naphthyl and biphenylyl;

or

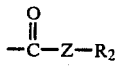

wherein Z is $$-O- \quad \text{or} \quad -\underset{\underset{R_3}{|}}{N}-;$$

$R_2$ and $R_3$ are individually hydrogen, alkyl, preferably alkyl containing 1 to 10 carbon atoms, such as methyl, ethyl, propyl, octyl and decyl; or aryl, preferably aryl containing 6 to 16 carbon atoms, such as phenyl and naphthyl; provided that $R_2$ is hydrogen when Z is $$-\underset{\underset{R_3}{|}}{N}-.$$

An especially useful polymeric binder within this group of binders is poly(vinyl acetate-co-vinyl benzoate-co-N-vinyl-2-pyrrolidone).

An overcoat layer is useful on the dye-forming EAR layer according to the invention. It is important that the overcoat layer not adversely affect the desired charge sensitivity and ohmic resistivity properties of the element according to the invention. Such an overcoat layer reduces fingerprinting and abrasion marks before and after exposure and processing. The overcoat layer is one or more of the described polymers which are useful as binders. These materials must be compatible with other components of the described element according to the invention and must be able to tolerate the processing temperatures which are useful for developing the described images.

Barrier layers, particularly polymeric barrier layers, are useful in dye-forming EAR elements and processes as described to separate dye image-forming layers. Such barrier layers enable control or prevention of transfer of particular components between layers. For example, a polymeric barrier layer can control the degree of transfer and development that can occur between layers in a multilayer dye-forming ETR element. The polymeric barrier layer can also provide prevention or control of intermixing of components during coating of the dye-forming layers in preparation of a dye-forming EAR element. Any polymer is useful as a barrier layer provided that the polymer does not adversely affect the desired electrical and image-forming properties of the dye-forming EAR element and is compatible with the components in the barrier layer and in other layers of the element, particularly contiguous layers. Highly useful polymers as barrier layers are those polymers that function as amine scavengers, that is the polymers comprise groups capable of reacting with amines, such as propanediamine, released by the dye-forming layers upon processing of the exposed dye-forming EAR element. Examples of useful polymers for barrier layer purposes are represented by the formula:

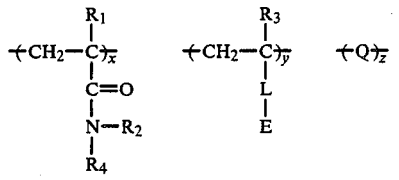

wherein:

$R_1$ and $R_3$ are individually hydrogen or methyl;

$R_2$ and $R_4$ are individually hydrogen or alkyl, such as alkyl containing 1 to 6 carbon atoms, for example methyl, ethyl, propyl, butyl and hexyl;

Q represents a recurring unit derived from a monomer having an appended sulfonic acid or sulfonate salt group, for example, sodium 3-acryloyloxypropanesulfonate, sodium 2-acrylamido-2-methyl propanesulfonate and other monomers described in U.S. Pat. Nos. 2,923,734; 3,024,221; 3,506,707; and *Research Disclosure*, Item No. 19551, July, 1980. E is an amine-reactive group, such as an electrophilic group which reacts with an amine, for example a chloroacetyl, chloromethyl, chloroethylsulfonyl, chloroethylcarbonyl, vinyl sulfonyl, aldehyde or carboxy group. L is a linking group such as ester (—COO—), amide (—CONH— or —NHCO—), alkylene, arylene or combinations of such linking groups, for example $-CONHC_6H_5CH_2-$, $-CONHCH_2NHCOCH_2CH_2-$, $-CONH(CH_2)_3NHCO-$, $-C_6H_4CH_2-$ and $-CONH(CH_2)_2CONH-$.

The x, y and z represent weight percent wherein x is 0 to 95 weight percent, y is 3 to 45 weight percent and z is 0 to 75 weight percent.

Examples of useful polymers for polymeric barrier layers are as follows:

Poly{acrylamide-co-N-[4-(2-chloroethylsulfonylmethyl)phenyl]acrylamide-co-sodium-2-acrylamido-2-methylpropanesulfonate} (weight ratio 75/20/5)

Poly{acrylamide-co-N-[3-(2-chloroethylsulfonyl)propionylaminomethyl]acrylamide} (weight ratio 80/20)

Poly{acrylamide-co-N-[3-(chloroacetamido)propyl]-methacrylamide-co-sodium 2-acrylamido-2-methylpropanesulfonate} (weight ratio 75/20/5)

Poly{acrylamide-co-N-[3-(2-chloroethylsulfonyl)propionylaminomethyl]acrylamide-co-sodium 2-acrylamido-2-methylpropanesulfonate} (weight ratio 75/20/5)

Poly{sodium 2-acrylamido-2-methylpropanesulfonate-co-N-[3-(2-chloroethylsulfonyl)propionylaminomethyl]acrylamide} (mole ratio 3/1; weight ratio 68/32)

Poly{sodium 2-acrylamido-2-methylpropanesulfonate-co-N-[3-(chloroacetamido)propyl]methacrylamide} (mole ratio 3/1; weight ratio 73/27)

Poly{sodium 2-acrylamido-2-methylpropanesulfonate-co-N-[4-(2-chloroethylsulfonylmethyl)phenyl]acrylamide} (mole ratio 3/1; weight ratio 67/33)

Poly{acrylamide-co-N-[3-(chloroacetamido)propyl]-methacrylamide} (weight ratio 80/20)

Poly{acrylamide-co-N-[4-(2-chloroethylsulfonylmethyl)phenyl]acrylamide} (weight ratio 95/5)

Poly{acrylamide-co-N-[4-(2-chloroethylsulfonylmethyl)phenyl]acrylamide} (weight ratio 80/20)

Poly[acrylamide-co-m- & p-(2-chloroethylsulfonylmethyl)styrene-co-sodium 2-acrylamido-2-methylpropanesulfonate] (weight ratio 75/20/5)

Poly{acrylamide-co-N-[3-(2-chloroethylsulfonyl)propionylaminomethyl]acrylamide} (weight ratio 80/20)

Poly[acrylamide-co-acrylic acid] (weight ratio 70/30)

A styrene-butadiene copolymer is not useful alone as a barrier layer because it does not have adequate barrier properties to control or prevent an undesired degree of transfer of components between layers.

The thickness of the barrier layer should be sufficient to enable the desired control or prevention of transfer of components between layers. Typically the barrier layer thickness is within the range of 0.1 to 2.0 microns.

In most cases, a photosensitive component is unnecessary and undesirable in a dye-forming EAR element as described. The photosensitive component is any photosensitive metal salt or complex which produces developable nuclei upon electrical exposure according to the invention. If a photosensitive component is present in the recording layer, an especially useful photosensitive metal salt is photosensitive silver halide, due to its desired properties in forming developable nuclei upon exposure. A preferred photosensitive silver halide is silver chloride, silver bromide, silver bromoiodide or mixtures thereof. For purposes of the invention, silver iodide is also considered to be a photosensitive silver halide. Very fine grain photographic silver halide is useful, although a range of grain size from fine grain to coarse grain photographic silver halide is included in the recording layer, if desired. The photographic silver halide is prepared by any of the procedures known in the photographic art.

If a photosensitive component is present in the described electrically activated recording layer, the described image-forming combination enables the concentration of the photosensitive component to be lower than normally would be expected in a photosensitive element. This lower concentration is enabled by the amplification effect of the image-forming combination, as described, as well as the formation of developable nuclei according the invention. In some instances, the concentration of photosensitive metal salt is sufficiently low that, after imagewise exposure and development of the photosensitive metal salt alone, in the absence of other of the described imaging components, the developed image is not visible to the unaided eye.

An illustrative combination of components useful as a dye-forming ETR material is the combination of oxidizable dye-forming agents, such as 4-nitrocatechol, or a sulfonamidodiphenylamine, such as 4-n-hexyloxy-2'-pivalamido-4'-(2,4,6-triisopropylphenyl)-N-sulfonamidodiphenylamine or methylene-bis[4-hydroxy-3-(2,4,6-triisopropylphenyl)]sulfonamidobenzene, or a sulfonamidophenol, such as 2,6-dichloro-4-phenylsulfonamidophenol, with a cobalt(III) amine complex in a polymeric binder. A dye-forming coupler as described can also be present in this combination of components.

The elements according to the invention, if desired, contain addenda which aid in producing a desired dye image. These addenda include, for example, development modifiers that function as speed-increasing compounds, hardeners, plasticizers and lubricants, coating aids, brighteners, absorbing and filter dyes. These addenda are described in, for example, *Research Disclosure,* Vol. 176, December 1978, Item 17643.

The element according to the invention comprises an electrically conductive support. The term "electrically conductive support" herein includes (a) supports that are electrically conductive without the need for separate addenda in the support or on the support to produce the desired degree of electrical conductivity, and (b) supports that comprise addenda or separate electrically conductive layers that enable the desired degree of electrical conductivity. Useful supports include electrically conductive cellulose ester, poly(vinyl acetal), poly(ethylene terephthalate), polycarbonate and polyester film supports and related films and resinous materials. Other supports are useful, such as glass, paper, metal and the like which can withstand the processing conditions described and do not adversely affect the charge-sensitive properties and ohmic resistivity which is desired. A flexible support is most useful. It is necessary that the various layers according to the invention adhere to the support. A subbing layer is useful for this purpose. Such a subbing layer is, for example, a poly(methylacrylate-co-vinylidene chloride-co-itaconic acid) subbing layer.

Preferred cobalt(III) complexes are those having a coordination number of six. A wide variety of ligands are useful to form a cobalt(III) complex. The preferred cobalt(III) complex is one which aids in generating an amine. Cobalt(III) complexes which rely upon chelation of cobalt(II) to form added dye density are also useful in materials according to the invention. Useful amine ligands in cobalt(III) complexes according to the invention include, for example, methylamine, ethylamine, ethylenediamine, propanediamine, ammines, and amino acids such as glycinato. The term "ammine" refers to ammonia, when functioning as a ligand, whereas "amine" indicates the broader class noted above. The diamine and ammine complexes are particularly useful in producing dye images.

The cobalt(III) complexes useful according to the invention include neutral compounds which are entirely free of either anions or cations. The cobalt(III) complexes also include one or more cations and anions as determined by the charge neutralization rule. Herein the terms "anion" and "cation" refer to non-ligand anions and non-ligand cations unless otherwise indicated. Useful cations are those which produce readily soluble cobalt(III) complexes, such as alkali metal and quaternary ammonium cations.

A wide variety of anions are useful, such as those listed in *Research Disclosure,* Vol. 184, Item No. 18436. The choice of an optimum anion depends in part on whether or not added compounds are present that are sensitive to, or reactive with, the anion.

Exemplary cobalt(III) complexes are those set forth in Table V. Further exemplary cobalt(III) complexes are described in Table I of U.S. Pat. No. 4,334,005.

TABLE V

| Exemplary Cobalt(III) Complexes | |
|---|---|
| C-1 | hexammine cobalt(III) trifluoroacetate |
| C-2 | chloropenta-ammine cobalt(III) bromide |
| C-3 | bis(ethylenediamine) di-ammine cobalt(III) perchlorate |
| C-4 | bis(methylamine) tetra-ammine-cobalt(III) hexafluorophosphate |
| C-5 | trinitrotris-ammine cobalt(III) |
| C-6 | tris(1,3-propanediamine) cobalt(III) trifluoroacetate |
| C-7 | bis(dimethylglyoxime) ethylaquo cobalt(III) |
| C-8 | penta-ammine carbonato cobalt(III) nitrate |
| C-9 | trans[bis(ethylenediammine) diazido cobalt(III)] chloride |
| C-10 | bis(ethylenediamine) dithiocyanato cobalt(III) fluoride |
| C-11 | triethylenetetramine dinitro cobalt(III) |
| C-12 | tris(1,3-propanediamine) cobalt(III) trifluoromethanesulfonate |

Certain cobalt(III) complexes are themselves amine responsive and can release their Lewis base ligands upon exposure to an amine. These complexes preferably contain an ammonia cleavable bond, such as a dichalcogenide bond. Such complexes have the added advantage of functioning both as image amplifiers and as base-releasing complexes capable of reduction in the presence of a reducing agent.

Examples of useful Lewis bases include ammonia, amines, hydroxy ion, carboxylates, mercaptides, thiocyanate, alkyl or aryl sulfinate, cyanide or sulfite.

For purposes of this invention, a reducing agent precursor is any compound that upon exposure to a Lewis base forms a reducing agent. The reducing agent, whether included in the composition originally or formed from a reducing agent precursor, undergoes an increase in reducing activity upon exposure to such bases.

Useful reducing agent precursors that upon exposure to a Lewis base form a reducing agent, provided the reducing agent is capable of reducing the reducible dye precursor and the Lewis base ligand releasing cobalt(III) complex, include quinones; phthalaldehyde; thioamides such as thiourea, thioacetamide, and thiosemicarbazides such as 1,4-diphenyl-3-thiosemicarbazide Lewis bases as described above, such as ammonia and primary or secondary amines, can undergo reductive addition with such reducing agent precursors to form the corresponding reducing agent.

Quinones are particularly useful reducing agent precursors. Preferred quinones are those which are unsubstituted in at least one quinoid ring position adjacent a carbonyl group, such as a 2 or 3 ring position in the case of 1,4-benzoquinones and 1,4-naphthoquinones. Also, at least one of the substituents on the quinoid ring is electronegative, such as keto, carboxylic acid, carboxylate, carboxylic acid amide, carboxylic acid ester, sulfonic acid ester, sulfonic acid amide, cyano, nitro, halo, or aryl. Exemplary quinones useful in the practice of the invention include 2-acetyl-5-methyl-1,4-benzoquinone
2-phenyl-1,4-benzoquinone
2-phenylsulfonyl-1,4-benzoquinone
2-methoxy-1,4-benzoquinone
2-phenyl-1,4-naphthoquinone
2-acetyl-1,4-naphthoquinone
2-n-butoxycarbonyl-1,4-benzoquinone
2-phenylsulfonamido-1,4-benzoquinone
2-t-butyl-1,4-benzoquinone
2-phenylsulfonyl-5,6-dimethyl-1,4-benzoquinone Particularly useful reducing agents when component (c) is a tetrazolium or triazolium salt are those that upon exposure to a Lewis base are capable of being ionized, the Lewis base being capable of reductive addition to the oxidized form of the reducing agent, or upon heating undergo an increase in reducing activity, provided that after such an increase, the reducing agent is capable of reducing the dye-forming compound and the Lewis base ligand releasing cobalt(III) complex. The activity of the reducing agent must be low enough to be stable toward the reducible dye-forming compound and the cobalt(III) complex, but high enough to respond to the Lewis base and initiate the reaction sequence. During the reaction sequence, the Lewis base ligands released by the cobalt(III) complex increase the activity of the reducing agent and may undergo reductive addition with the oxidized reducing agent.

Hydroquinones are particularly useful as reducing agents when component (c) is a tetrazolium or triazolium salt.

Examples of hydroquinones useful in the practice of the invention include 2-acetyl-5-methylhydroquinone
2-phenylsulfonylhydroquinone
2-n-butylsulfonylhydroquinone
2-α-benzylsulfonylhydroquinone
2-methylsulfonylhydroquinone
2-methylsulfonyl-3,5-dichlorohydroquinone
2,6-dichlorohydroquinone
2-sulfonylphenyl-5,6-dimethylhydroquinone
2-β-naphthylsulfonylhydroquinone
2-carboxy-1,4-hydroquinone The stability of the dye-forming EAR layers of elements according to the invention comprising the cobalt(III) Lewis base complex depend, in part, on the selection of an anion for the complexes. The order of preference of anion will vary with the particular cobalt(III) Lewis base, the particular coupler, developing agent, and other components of the dye-forming EAR element. For tris(trimethylenediamine) cobalt(III) complexes the order of anion preference based on storage stability during storage is (1) $CF_3SO_3^{\ominus}$, (2) $C_3F_7CO_2^{\ominus}$, (3) $CF_3CO_2^{\ominus}$, (4) $BF_4^{\ominus}$.

At least one of the imaging layers of the dye-forming EAR element can optionally comprise a hydrazone reducing agent, such as a sulfonylhydrazone reducing agent, with a cobalt(III) amine complex and a dye-forming coupler. The imaging layer can also comprise an acid, such as p-toluenesulfonic acid, to aid in imaging. Examples of useful hydrazone reducing agents are:

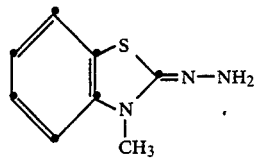

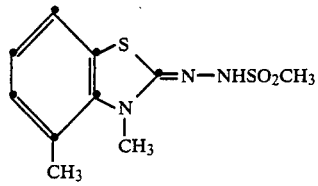

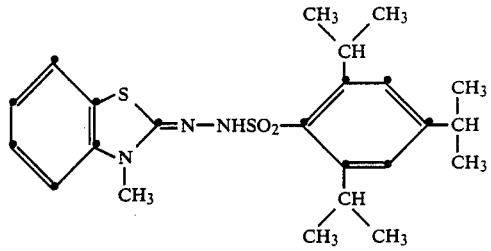

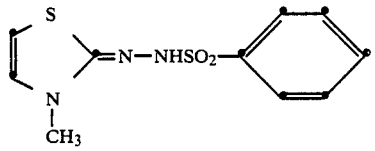

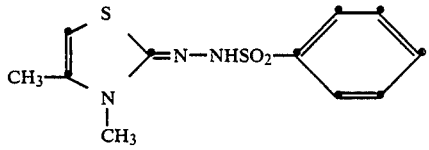

Any dye-forming couplers or combination of dye-forming couplers known in the photographic art are useful with the hydrazone reducing agents. Dye-forming couplers or combinations of dye-forming couplers that form yellow dyes with sulfonylhydrazone reducing agents are particularly useful.

Another illustrative dye-forming EAR element comprises the combination of (a) a sulfonylhydrazone reducing agent, especially a base activated sulfonylhydrazone reducing agent, which in oxidized form is capable of oxidative coupling, (b) a cobalt(III) amine complex, (c) optionally an incorporated acid, such as p-toluenesulfonic acid or benzoic acid, and (d) a dye-forming coupler which is capable of reacting with the oxidized form of the reducing agent to form a dye. The combination is preferably in a polymeric binder which enables the desired dye-forming reaction upon exposure and processing. The combination of components also provides a useful thermographic imaging material. While not typically desirable, the incorporation of a photoreductant or photoinhibitor known in the photothermographic materials art in the element also enables the imaging element to be a photothermographic imaging material.

Figure 2:
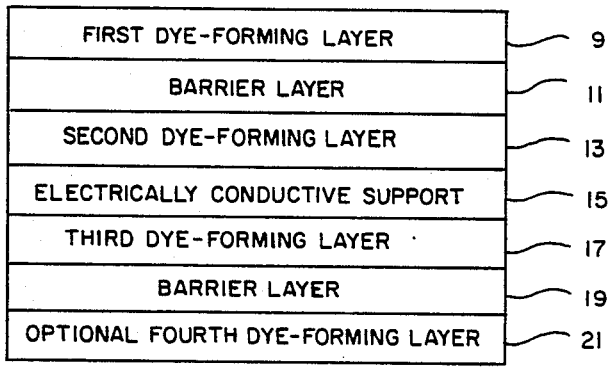
FIG. 2 schematically illustrates another dye-forming EAR element according to another illustrative embodiment of the invention.
Figure 3:
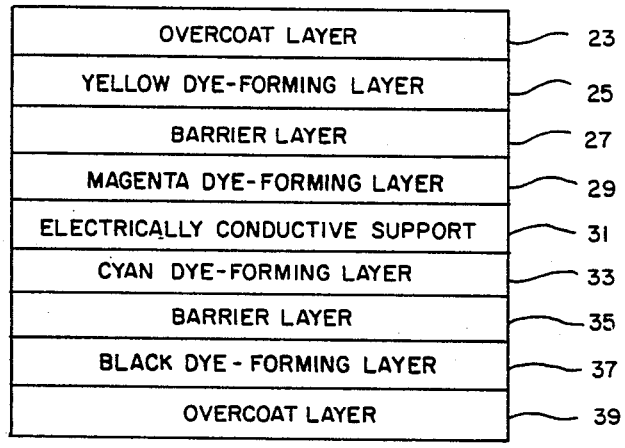
FIG. 3 schematically illustrates a dye-forming ETR element according to an illustrative embodiment of the invention.

Referring to the drawings, element embodiments of the invention are schematically illustrated in FIGS. 1, 2 and 3. The embodiment illustrated in FIG. 1 comprises a first dye-forming EAR recording layer 1 and a second dye-forming EAR layer 3 separated by barrier layer 7, typically a polymeric acid barrier layer, on an electrically conductive support 5, typically a transparent electrically conductive support. The layers 1 and 3 can form dye images of the same hue, for example with differing densities, or can form dye images of differing hues depending upon the polarity of electrical exposure of the element. For example, layer 1 can provide a cyan, magenta, yellow, red, gree, blue or black dye image upon positive polarity charge exposure and processing and layer 3 can provide a dye image of a hue different from that in layer 1 upon negative polarity charge exposure and processing.

The embodiment schematically illustrated in FIG. 2 comprises a first dye-forming EAR layer 9 and a second dye-forming EAR layer 13 separated by a barrier layer 11 on the first side of an electrically conductive support 15. The electrically conductive support 15 bears, on the side opposite the first side, a third dye-forming EAR layer 17 and a fourth dye-forming EAR layer 21 separated by a barrier layer 19. Each one of dye-forming layers 9, 13, 17 and 21 can provide a dye image of a hue differing from the hue of each of the other dye-forming layers. For example, layer 9 can provide a cyan dye image; layer 13 a magenta dye image; layer 17 a yellow dye image; and layer 21 can provide a black dye image.

Another illustrative embodiment is schematically shown in FIG. 3 wherein electrically conductive support 31 bears on the first side an overcoat layer 23, such as a poly(vinyl butyral) or transparent silicone rubber overcoat, on dye-forming layer 25 capable of forming a yellow dye image; barrier layer 27; and dye-forming layer 29 capable of forming a magenta dye image. The electrically conductive support 31 opposite the first side bears overcoat layer 39, such as a poly(vinyl butyral) or transparent silicone rubber layer; a dye-forming layer 37 capable of forming a black dye image; a barrier layer 35, such as a polymeric acid barrier; and a dye-forming layer 33 capable of forming a cyan dye image.

The electrically conductive supports in the Figures can comprise, for example, a poly(ethylene terephthalate) film having thereon, in sequence, a subbing layer not shown, such as a subbing layer comprising a poly(alkyl acylate-co-vinylidene chloride-co-itaconic acid) layer. On the subbing layer can be an electrically conductive layer, not shown, such as a cermet layer. This electrically conductive layer, not shown, can have thereon, also not shown, a polymer layer which can increase the sensitivity of the dye-forming EAR element, such as an electrically active conductive layer (EAC layer) as described in, for example, U.S. Pat. No. 4,343,880. such an electrically active conductive layer can be, for example, a poly(alkyl acrylate-co-vinylidene chloride-co-itaconic acid) layer. Useful polymers for the subbing layers, not shown, and/or the EAC layer, also not shown, are described in, for example, U.S. Pat. No. 3,271,345.

Referring to the Table illustrated in FIG. 4 and the dye-forming EAR element illustrated in FIG. 4, a positive polarity charge exposure forms a developable latent image in layer 49 without forming a latent image in other layers of the element. A negative polarity charge exposure forms a developable latent image in layer 41 without forming an image in other of the layers.

A high negative or high positive polarity charge exposure can, upon processing, cause development of dye image in layer 45 by infectious development from layer 41 and/or layer 49.

Figure 5:
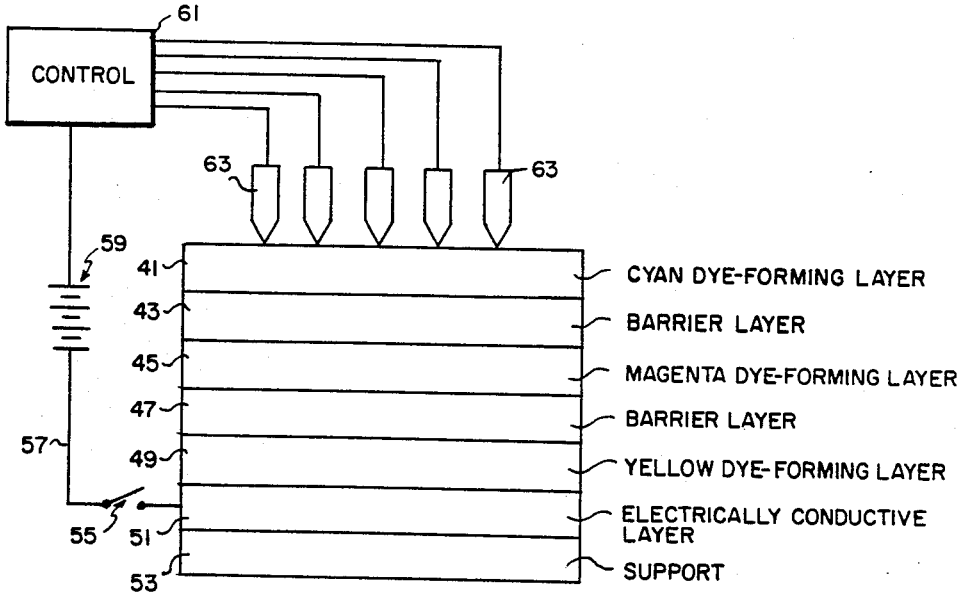
FIG. 5 schematically illustrates a dye-forming EAR element according to the invention.

If the dye-forming ETR element of FIG. 5 is exposed to a high negative polarity electrical exposure, such as a charge exposure at 10 milicoulombs/cm$^2$ to 10 coulombs/cm$^2$, a dye image will be formed in both layer 41 and layer 45 upon processing. The dye image in layer 45 will be formed by infectious development from layer 41.

If the dye-forming ETR element of FIG. 5 is imagewise exposed to high positive polarity exposure, such as a charge exposure at 10 milicoulombs/cm$^2$ to 10 coulombs/cm$^2$, a dye image will be formed in both layer 49 and layer 45 upon processing. The dye image in layer 45 will be formed by infectious development from layer 49.

If the dye-forming ETR element of FIG. 5 is exposed to a high negative polarity charge exposure and then a high positive polarity charge exposure, an image will be formed upon processing in each of layers 41, 45 and 49. The image in layer 45 will be formed by infectious development from both layers 41 and 49.

If the dye-forming ETR element of FIG. 5 is exposed first to a low negative polarity charge exposure, such as at 10 milicoulombs/cm$^2$ to 1 coulomb/cm$^2$, and then a low positive polarity charge exposure, such as at 10 milicoulombs/cm$^2$ to 1 coulomb/cm$^2$; or, exposed first to a low positive polarity charge exposure, such as at 10 milicoulombs/cm$^2$ to 1 coulomb/cm$^2$, and then a low negative polarity charge exposure, such as 10 milicoulombs/cm$^2$ to 1 coulomb/cm$^2$, the result is formation of a latent image in layer 41 and formation of a latent image in layer 49. Upon processing, a dye image is formed in both layers 49 and 41 without formation of a dye image in other layer of the element.

If the dye-forming ETR element of FIG. 5 is imagewise exposed to a low negative polarity charge exposure, such as 10 milicoulombs/cm$^2$ to 1 coulomb/cm$^2$, a dye image is formed in layer 41 upon processing. A dye image is not formed in other layers of the element.

If the dye-forming ETR element of FIG. 5 is imagewise exposed to a low positive polarity charge exposure, such as at 10 milicoulombs/cm$^2$ to 1 coulomb/cm$^2$, a dye image is formed in layer 49 upon processing. A dye image is not formed in other layers of the element.

If the dye-forming ETR element of FIG. 5 is imagewise exposed to a high positive polarity charge exposure and then a low negative polarity charge exposure or a high negative polarity charge exposure and then a low positive polarity charge exposure, a dye image is formed in layers 41, 45 and 49. The dye image in layer 45 is formed by infectious development.

In FIG. 5 the switch 55 is in an open condition prior to imagewise electrical exposure. The electrical connecting means 57 connects electrically conducting layer 51 on support 53 through a power source 59 and a control means 61 and then to electrodes 63 which enable imagewise electrical exposure at the appropriate time. Barrier layers 43 and 47 are optionally present.

Figure 6:
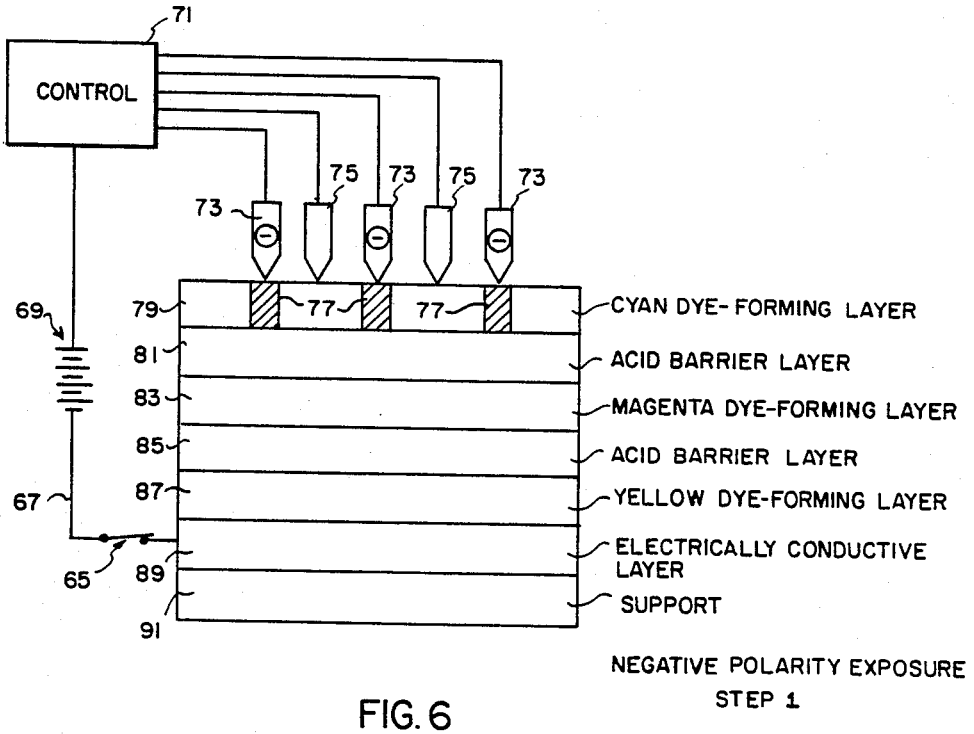
FIG. 6 schematically illustrates an exposure step according to the invention including a negative polarity imagewise exposure.

FIG. 6 in the drawings schematically illustrates a first electrical exposure of a dye-forming ETR element as in FIG. 5. In FIG. 6 the switch 65 is in a closed condition enabling electrical current to pass through the electrical connecting means 67, power source 69, control means 71 to electrodes 73. The control means 71 enables negative polarity to be applied to electrodes 73 and not to electrodes 75. The charge exposure with negative polarity applied to electrode 73 enables latent images 77 to be formed in the cyan dye-forming layer 79. The other layers 81, 83, 85, 87 and 89 on support 91 do not have images formed in this exposure step. The exposure step from FIG. 6 is designated herein as the negative polarity exposure step 1.

Figure 7:
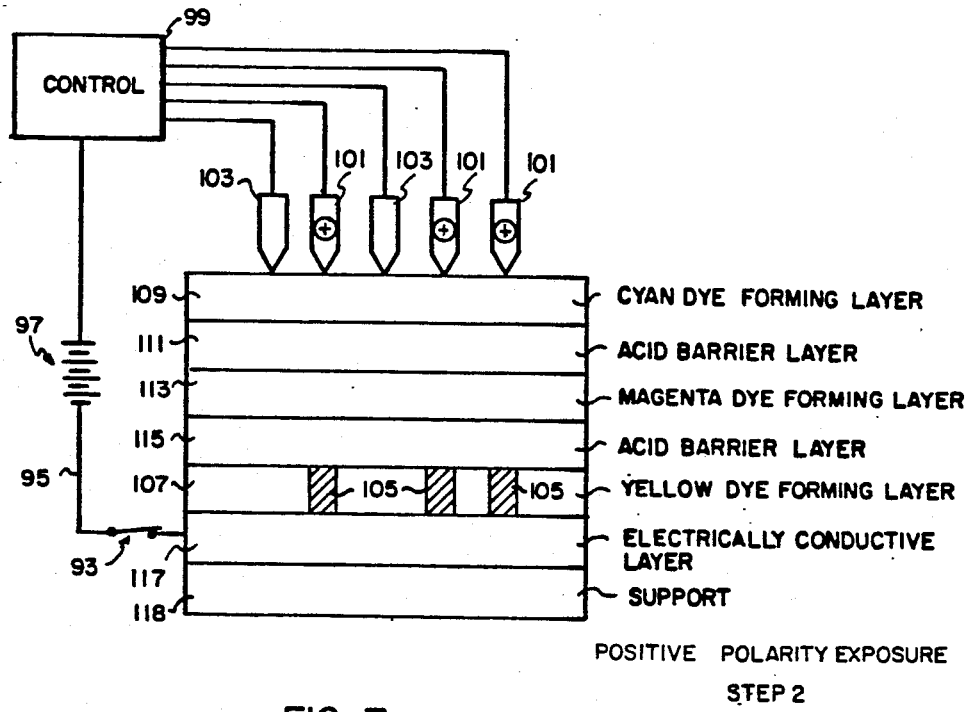
FIG. 7 schematically illustrates an exposure step according to the invention including a positive polarity imagewise exposure.

FIG. 7 in the drawings schematically illustrates a second electrical exposure of a dye-forming ETR element from FIG. 5. In FIG. 7 the switch 93 is in a closed condition enabling electrical current to pass through the electrical connecting means 95, power source 97, control means 99 to electrodes 101. The control means 99 enables electrical current to flow selectively to the electrodes. This is illustrated by the positive polarity electrical current flow to electrodes 101, without electrical current flow to electrodes 103. This electrical exposure enables formation of images 105 in layer 107 without adversely affecting the images formed in layer 109 from exposure step 1 in FIG. 6. No latent images are formed in other layers 111, 113 and 115. The electrical exposures as illustrated in FIGS. 6 and 7 are weak electrical exposures and do not enable development of a dye image in the magenta dye-forming layer 113. Optionally, the electrical exposures illustrated in FIGS. 6 and 7 could be strong electrical exposures which would enable formation of an image in layer 113 upon processing by infectious development.

The electrical exposure steps in FIGS. 6 and 7 can be carried out in room light when the dye-forming ETR element contains no photosensitive component.

Figure 8:
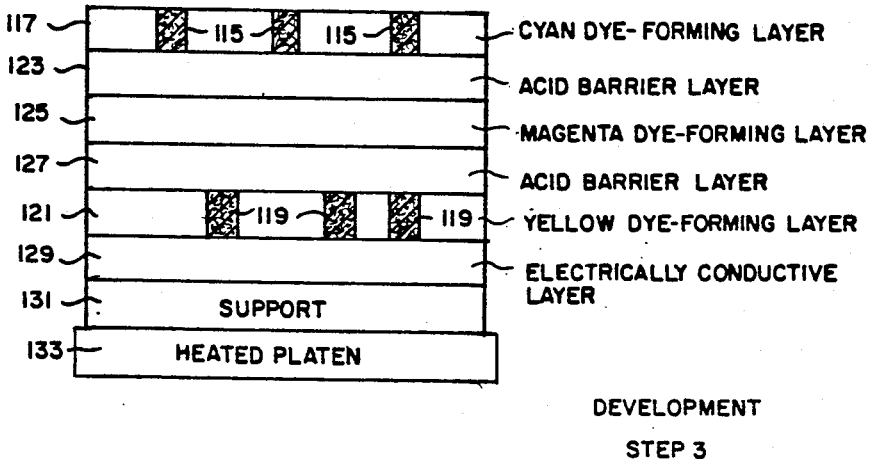
FIG. 8 schematically illustrates a thermal development step to produce a dye image in another illustrative embodiment according to the invention.

After the exposure step 2, the exposed ETR element is processed as illustrated in FIG. 8 to form dye images in the exposed areas. According to FIG. 8 dye images 115 are formed in cyan dye-forming layer 117 based on exposure step 1. Dye images 119 are also formed in yellow dye-forming layer 121 based on exposure step 2. Images are not formed in acid barrier layer 123, magenta dye-forming layer 125, acid barrier layer 127 or electrically conductive layer 129 on support 131. Development of dye images in FIG. 8 is carried out by, for example, contacting the support 131 of the element with a heated platen 133 at a temperature, such as within the range of about 80° C. to about 200° C., for a time sufficient to enable development of the dye images in layers 117 and 121. Optionally, processing in FIG. 8 can be carried out by means of processing solutions or baths.

The described layers according to the invention are coated by coating procedures known in the photographic art, including dip coating, airknife coating, curtain coating or extrusion coating, using hoppers known in the photographic art. If desired, two or more layers are coated simultaneously.

The various components of the materials according to the invention are prepared for coating by mixing the components with solutions or mixtures, including organic solvents, depending upon the particular charge-sensitive material and the components. The components are mixed and added by means of procedures known in the photographic art.

In one embodiment the cobalt(III) coordination complex, reducing agent or reducing agent precursor, dye-forming coupler, and an organic acid or inorganic acid are dissolved in a polymeric binder solution and coated as at least one of the dye-forming layers.

Useful dye-forming EAR elements according to the invention comprise an electrically conductive support having thereon at least two dye-forming EAR layers each of which has a thickness within the range of about 1 to about 30 microns, typically within the range of 2 to 15 microns. The optimum layer thickness of each of the layers of an element according to the invention depends upon such factors as the particular ohmic resistivity desired, charge sensitivity, particular components of the layers and the desired image.

A "melt-forming compound" is useful in the recording layers according to the invention to produce an improved developed image. The term "melt-forming compound" herein means a compound which, upon heating to the described processing temperature, produces an improved reaction medium, typically a molten medium, wherein the described image-forming combination can produce a desired image upon development. The exact nature of the reaction medium at the processing temperature described is not fully understood. It is believed that at the reaction temperature, as described, a melt occurs which permits the reaction components to better interact. If desired, a melt-forming compound is included with other components of the recording layer prior to coating on the described support. Examples of useful melt-forming compounds include succinimide, dimethyl urea, sulfamide and acetamide.

The following examples are included for a further understanding of the invention.

EXAMPLE 1

This example illustrates formation of a dye images by means of a positive polarity charge exposure of a dye-forming EAR element capable of forming a multicolor image.

A dye-forming EAR element was prepared having the following layer arrangement:

| | |
|---|---|
| (c) | second dye-forming layer |
| (b) | barrier layer |
| (a) | first dye-forming layer |
| | poly(methyl acrylate-co-vinylidene chloride) layer |
| | electrically conductive support |

This layer arrangement is similar to that illustrated in FIG. 1 of the drawings with the addition of a poly(methyl acrylate-co-vinylidene chloride) layer.

An electrically conductive support in this example comprised a poly(ethylene terephthalate) film having a cermet layer (electrically conductive layer) with a layer thereon of poly(methyl acrylate-co-vinylidene chloride) (weight ratio: 80:20).

The layer (a) which was a red dye-forming layer was coated on the electrically conductive support at a wet coating thickness of 100 microns. The coating composition of layer (a) of this example consisted of:

| | |
|---|---|
| cellulose acetate butyrate (binder) (6.25% by weight solution in acetone) | 10 mL |
| water | 0.5 mL |
| surfactant (SF 1066, silicone surfactant, trademark of and available from General Electric Company, U.S.A.) | 0.06 g |
| 2,5-dihydroxy-4-methylacetophenone (reducing agent) | 0.066 g |
| tris(trimethylenediamine) cobalt(III) trifluoroacetate (cobalt(III) amine complex) | 0.510 g |
| 2-(p-iodiphenyl)-3-(p-nitrophenyl)-5-phenyl-2H—tetrazolium tetrafluoroborate (dye-forming compound) | 0.115 g |

The resulting layer (a) was permitted to dry at 45° C. for 5 minutes.

The layer (b) which was a barrier layer was coated on layer (a). The layer (b) was prepared by coating on layer (a) a toluene-ethanol (90:10 parts by volume) solution containing 100 g/L of butadiene-styrene copolymer (KR-03 which is a tradename of and available from Philips Company, U.S.A.) and 10 g/L of p-toluenesulfonic acid with surfactant (SF-1066 which is a silicone surfactant, available from and a trademark of General Electric Company, U.S.A.) at a wet coating coverage of 2 mL/ft$^2$ (0.19 mL/m$^2$). The solvents were removed by drying to provide a layer 1 to 1.5 microns thick having 200 mg/ft$^2$ (2152 mg/m$^2$) of styrene-butadiene copolymer latex and 20 mg/ft$^2$ (215.2 mg/m$^2$) of p-toluenesulfonic acid.

The layer (c) which was a blue dye-forming layer was coated on barrier layer (b). The layer (c) was coated at a wet coating thickness of 100 microns and contained the following:

| | |
|---|---|
| cellulose acetate butyrate (binder) (6.25% by weight solution in acetone) | 10 mL |
| water | 0.5 mL |
| surfactant (SF-1066, silicone surfactant) | 0.06 g |
| 2,5-dihydroxy-4-methylacetophenone (reducing agent) | 0.066 g |
| tris(trimethylenediamine) cobalt(III) trifluoroacetate monohydrate (cobalt(III) amine complex) | 0.510 g |
| ethanol-water (4:1 parts by volume) solution containing 0.080 g of Nitro Blue Tetrazolium Chloride (dye-forming compound) | 2 mL |

The resulting layer (c) was dried for 5 minutes at 45° C.

The resulting dye-forming EAR element was imagewise electrically exposed by means of a mercury contact electrode. The imagewise electrical exposure was at a voltage of 500 V. A positive polarity was applied to the mercury electrode. A print-out dye image was formed having a blue transmission density of 0.38 at a charge exposure of 8.8 mcoulombs/cm$^2$ with a minimum density of 0.10.

Cross sectional micrographic examination of the element containing the visible image revealed that most of the image was concentrated in the layer (a) nearest the interface with the layer containing poly(methyl acrylate-co-vinylidene chloride).

EXAMPLE 2

This illustrates formation of a dye image by means of a negative polarity charge exposure of a dye-forming EAR element as described in Example 1 capable of forming a multicolor image.

A dye-forming EAR element was prepared as in Example 1. The element was imagewise electrically exposed by applying a negative polarity to the mercury electrode. A visible dye print-out image was formed having a 0.43 maximum blue transmission density at a charge exposure of 8.8 mcoulombs/cm$^2$ with a minimum density of 0.10.

Cross sectional micrographic examination of the exposed dye-forming EAR element containing the visible image reveals that most of the dye image is concentrated in the area of layer (c) farthest from barrier layer (b).

EXAMPLE 3

This illustrates formation of a dye image by both a first positive polarity charge exposure and a second negative polarity charge exposure of a dye-forming EAR element capable of forming a multicolor image.

A dye-forming EAR element was prepared as in Example 1. The dye-forming EAR element was imagewise exposed with an electrical exposure of 8.8 mcoulombs/cm$^2$ by means of a mercury electrode with a positive polarity as described in Example 1. Then the dye-forming EAR element was imagewise exposed with an electrical exposure of 8.8 mcoulombs/cm$^2$ by means of a mercury contact electrode with a negative polarity. A print-out image was obtained with a blue maximum transmission density of 0.41 and having a maximum density of 0.10.

Cross sectional micrographic examination of the dye-forming EAR element containing the visible image revealed that the positive polarity exposure caused most of the image density formation of layer (a) at the interface of layer (a) and the layer comprising poly(methyl acrylate-co-vinylidene chloride). The micrographic examination also revealed the negative polarity exposure caused most of the image density formation of layer (c) in the portion of layer (c) farthest from barrier layer (b).

EXAMPLE 4

This illustrates formation of a dye image by means of thermally processing an exposed dye-forming ETR element according to the invention.

A dye-forming ETR element was prepared and imagewise electrically exposed as described in Example 1 with the exception that the charge exposure was decreased to 0.88 mcoulombs/cm$^2$.

The exposed dye-forming electrothermographic element was uniformly heated with the side of the element containing the image-forming layers facing the heating means which was a heated platen. The exposed ETR element was heated for 8 seconds at 105° C. to form a dye image having a blue maximum transmission density of 1.17 with a minimum density of 0.19.

Micrographic examination of a cross section of the processed element revealed image dye formation predominantly in the layer (a).

EXAMPLE 5

This also illustrates formation of a dye image by means of thermally processing an exposed dye-forming ETR element according to the invention.

A dye-forming ETR element was prepared and imagewise electrically exposed as described in Example 1 with the exception that the charge exposure was with a negative polarity.

The exposed dye-forming ETR element was uniformly heated with the side of the element containing the image-forming layers facing the heating means which was a heated platen. The exposed dye-forming ETR element was heated for 8 seconds at 105° C. to form a dye image having a blue maximum transmission density of 1.42 with a minimum density of 0.19.

Micrographic examination of a cross section of the processed element revealed image dye formation predominantly in the layer (c).

EXAMPLE 6

This illustrates formation of a dye image in each of two layers of a dye-forming ETR element according to the invention by means of thermal processing.

A dye-forming ETR element was prepared and imagewise electrically exposed as described in Example 3 except that the electrical exposure was decreased to 0.88 mcoulombs/cm$^2$. The exposed element was thermally processed at 105° C. for 8 seconds of form a dye image having a maximum transmission density of 1.85 with a minimum density of 0.19.

Micrographic examination of a cross section of the processed element revealed image dye formation in both layer (a) and layer (c).

EXAMPLE 7

This example illustrates formation of a dye image by means of a positive polarity electrical exposure of a dye-forming ETR element according to the invention. The element had the following layer arrangement:

| | |
|---|---|
| (e) | Cyan Dye-forming Layer |
| (d) | Polymer Barrier Layer |
| (c) | Magenta Dye-forming Layer |
| (b) | Polymer Subbing Layer |
| (a) | Cermet Layer |
| | Support |

The dye-forming ETR element according to the invention was prepared by coating the following layers respectively on an electrically conductive support comprising a poly(ethylene terephthalate) film having thereon an electrically conductive cermet coating (a) and a poly(methyl acrylate-co-vinylidene chloride) coating (b).

Layer (c):

The following magenta dye-forming composition was spin-coated at 250 rpm on the poly(methyl acrylate-co-vinylidene chloride) layer (b): 15.85 ml of a 14.2% by weight solution of poly(vinyl acetate-co-vinylpyrrolidone-co-vinyl benzoate) (50/30/20) binder in methanol:acetone (80:20 parts by volume); 14.15 ml of methanol:acetone (7:3 parts by volume); 0.090 g of siloxane surfactant (SF-1066, available from and a trademark of General Electrical Company, U.S.A.); 1.179 g of tris(trimethylenediamine) cobalt(III) trifluoromethanesulfonate; 0.333 g of the coupler:

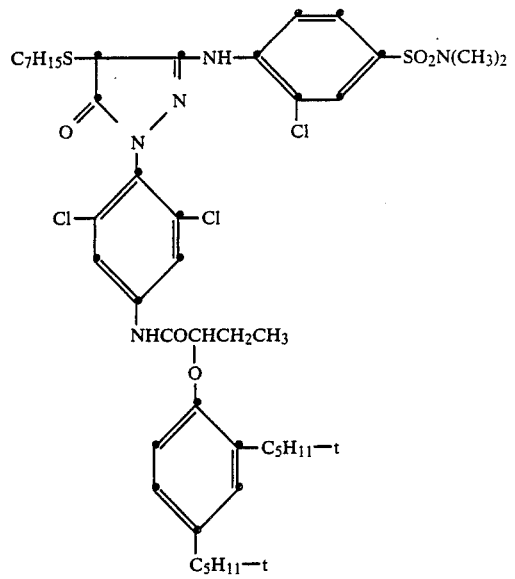

0.102 g of 2,6-dibromo-3-methyl-p-aminophenol (developer); 0.036 g of p-toluenesulfonic acid; 0.480 g of ethyleneoxide-propylene glycol surfactant (Pluronic-F-98, which is a trademark of and available from BASF-Wyandotte Corporation, U.S.A.); 0.240 g of lithium trifluoroacetate.

Layer (d):

The following barrier layer (d) was spin-coated at 250 rpm on the magenta dye-forming layer (c): The aqueous coating composition for layer (d) contained 60 g/l of poly{acrylamide-co-N-[3-(chloroacetamide)propyl]methacrylamide} (80/20 weight ratio) and 25 g/l of ethylene glycol and 5 g/l of FC-430 fluorocarbon surfactant (FC-430 is a fluorocarbon surfactant that is a trademark of and available from the 3M Company, U.S.A.).

Layer (e):

The following cyan dye-forming composition was spin-coated on layer (d) at 200 rpm: 15.85 ml of a 14.2% by weight solution of poly(vinyl acetate-co-N-vinyl-2-pyrrolidone-co-vinyl benzoate) (50/30/20 weight ratio) binder in 80:20 by volume methanol:acetone; 14.15 ml of 7:3 by volume methanol:acetone; 0.090 g of siloxane surfactant (SF-1066); 1.662 g of tris(trimethylenediamine) cobalt(III) trifluoromethanesulfonate; 0.561 g of coupler:

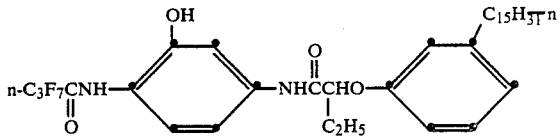

coupler; 0.153 g of 2,6-dibromo-3-methyl-p-aminophenol developer; 0.108 g of p-toluenesulfonic acid; 0.480 g of ethylene oxide-propylene glycol surfactant (Pluronic-F-98); 0.240 g of lithium trifluoroacetate.

The resulting dye-forming ETR element was imagewise electrically exposed by means of a mercury contact electrode exposing device. A voltage of 150 V was applied to the dye-forming ETR element during exposure. A positive polarity was applied to the mercury electrode.

The exposed dye-forming ETR element was uniformly heated for 5 seconds at 125° C. to form a magenta dye image. The magenta dye image has a green maximum transmission density of 1.77 for a charge exposure of 2.3 mcoulombs/cm$^2$. The magenta dye image had a minimum density of 0.18.

EXAMPLE 8

This example illustrates formation of a dye image by means of a negative polarity exposure of the dye-forming ETR element described in Example 7.

A dye-forming ETR element was prepared as described in Example 7. The resulting dye-forming ETR element was imagewise exposed by applying a negative polarity to the mercury contact electrode. The exposed dye-forming ETR element was then uniformly heated as described in Example 7 to form a cyan dye image in the element. The resulting cyan dye image had a red maximum transmission capacity of 1.66 at a charge exposure of 2.0 mcoulombs/cm$^2$ with a minimum density of 0.18.

This illustrates that the dye-forming ETR element of Example 7 forms a magenta dye image or cyan dye image depending upon the polarity of electrical exposure.

The invention has been described in detail with particular reference to preferred embodiments thereof, but it will be understood that variations and modifications can be effected within the spirit and scope of the invention.

What is claimed is:

1. In a dye-forming electrically activatable recording process in which a multilayer dye-forming electrically activatable recording element is imagewise exposed to electrical charge to form a developable image and then processed to form a dye image, the steps comprising (I) imagewise exposing the multilayer dye-forming electrically activatable recording element to electrical charge of one polarity to form a developable latent image in at least one of the layers; then (II) imagewise exposing the multilayer dye-forming electrically activatable recording element to electrical charge of a polarity opposite that from step (I) to form a developable latent image in another of the layers of the element; and, then (III) developing a dye image in the resulting element.

2. A process as in claim 1 wherein said dye image is a multicolor image.

3. A dye-forming electrically activatable recording process for producing a dye image in a dye-forming electrically activatable recording element comprising an electrically conductive support bearing at least one dye-forming electrically activatable recording layer (A) and at least one dye-forming electrically activatable recording layer (B), said process comprising the steps:

(I) applying a first charge exposure to said recording element for a time sufficient to produce a dye-forming image in one of dye-forming electrically activatable recording layer (A) or (B); then (II) applying a second charge exposure, which is opposite in polarity to said first charge exposure, to said recording element for a time sufficient to produce a dye-forming image in the dye-forming electrically activatable recording layer (A) or (B) not containing a dye-forming image from step (I); and, then (III) developing the exposed electrically activatable recording element to form a dye image in at least one of said layers (A) and (B).

4. In a process of forming a dye image in a dye-forming electrically activatable recording element comprising at least three electrically activatable image recording layers (A), (B) and (C) capable of forming dye images, the steps comprising (I) imagewise exposing layer (A) to a positive polarity charge exposure for a time sufficient to form a developable image in layer (A) without adversely affecting layers (B) and (C); then (II) imagewise exposing layer (C) to a negative polarity charge exposure for a time sufficient to form a developable image in layer (C) without adversely affecting layers (A) and (B); and (III) processing said element for a time sufficient to form dye images in at least said layers (A) and (C).

5. A process as in claim 4 wherein said processing in (III) comprises developing said element in a color developer bath to form a dye image in layers (A) and (C) and to cause development of a dye image in layer (B).

6. A dye-forming electrically activatable recording process as in claim 1 wherein said multilayer dye-forming electrically activatable recording element comprises an electrically conductive support bearing (A) a dye-forming electrically activatable recording layer, capable of forming a yellow dye image, comprising (i) a reducing agent or reducing agent precursor capable of being activated by a Lewis base, (ii) a cobalt(III) Lewis base complex, and (iii) a reducible dye that has an oxidation state above that of the conjugate dye, or a dye capable of changing its wavelength of absorption by reaction with a Lewis base to form a yellow dye, or a dye-forming coupler capable of forming a yellow dye upon reaction with the oxidized form of said reducing agent;

(B) a dye-forming electrically activatable recording layer, capable of forming a magenta dye image, comprising (i) a reducing agent or reducing agent precursor capable of being activated by a Lewis base, (ii) a cobalt(III) Lewis base complex, and (iii) a reducible dye that has an oxidation state above that of the conjugate dye, or a dye capable of changing its wavelength of absorption by reaction with a Lewis base to form a magenta dye, or a dye-forming coupler capable of forming a magenta dye upon reaction with the oxidized form of said reducing agent; and (C) a dye-forming electrically activatable recording layer, capable of forming a cyan dye image, comprising (i) a reducing agent or reducing agent precursor capable of being activated by a Lewis base, (ii) a cobalt(III) Lewis base complex, and (iii) a reducible dye that has an oxidation state above that of the conjugate dye, or a dye capable of changing its wavelength of absorption by reaction with a Lewis base to form a cyan dye, or a dye-forming coupler capable of forming a cyan dye upon reaction with the oxidized form of said reducing agent.

7. A process of forming a dye image in a dye-forming electrically activatable recording element comprising an electrically conductive support bearing on the first side of said support in sequence (A) a first dye-forming electrically activatable recording layer comprising, in a binder,
  (i) a cobalt(III) amine complex,
  (ii) a dye-forming coupler (x) capable of oxidative coupling with the oxidized form of a color developing agent to form a cyan dye, and
  (iii) a color developing agent capable in oxidized form of reacting with said coupler (x);
(B) a first polymeric acid barrier layer;
(C) a second dye-forming electrically activatable recording layer comprising, in a binder,
  (i) a cobalt(III) amine complex,
  (ii) a dye-forming coupler (y) capable of oxidative coupling with the oxidized form of a color developing agent to form a magenta dye, and
  (iii) a color developing agent capable in oxidized form of reacting with said coupler (y) to form a magenta dye;
(D) a second polymeric acid barrier layer;
(E) a third dye-forming electrically activatable recording layer comprising, in a binder,
  (i) a cobalt(III) amine complex,
  (ii) a dye-forming coupler (z) capable of oxidative coupling with the oxidized form of a color developing agent to form a yellow dye, and
  (iii) a color developing agent capable in oxidized form of reacting with said coupler (z); and
(F) an overcoat layer; and on the side of said support opposite to said first side;
(G) a fourth dye-forming electrically activatable recording layer comprising, in a binder,
  (i) a cobalt(III) amine complex,
  (ii) a dye-forming coupler (q) capable of oxidative coupling with the oxidized form of a color developing agent to form a black dye, and
  (iii) a color developing agent capable in oxidized form of reacting with said coupler (q); and
(H) an overcoat layer on layer (G);

said process comprising the steps:

(I) imagewise exposing the layers on said first side of said support to an electrical charge of one polarity to form a developable latent image in at least one of layers (A) and (E); then
(II) imagewise exposing the layers on said first side of said support to an electrical charge of one polarity opposite the polarity of step (I) to form a developable latent image in at least one of layers (A) and (E) not comprising a developable latent image from step (I);
(II) imagewise exposing layer (G) to electric charge to form a developable latent image in layer (G); said step (III) being carried out before, during or after steps (I) and (II); and
(IV) developing a dye image in the resulting element.

8. A process as in claim 1 also comprising transferring at least part of the resulting dye image to a dye image receiver.

9. A process as in claim 1 also wherein said developing is carried out by means of at least a color developer bath.

10. In a dye-forming electrothermographic recording process in which a multilayer dye-forming electrothermographic element is imagewise exposed to electrical charge to form a developable image and then heated to form a dye image, the steps comprising (I) imagewise exposing the multilayer dye-forming electrothermographic element to electrical charge of one polarity to form a developable latent image in at least one of the layers; then
(II) imagewise exposing the multilayer dye-forming electrothermographic element to electrical charge of a polarity opposite that from step (I) to form a developable latent image in another of the layers of the element; and then
(III) heating the exposed element from (II) at a temperature and for a time sufficient to develop a dye image in the resulting element.

11. A process as in claim 10 wherein said dye image is a multicolor image.

12. A process as in claim 10 also comprising transferring at least part of the resulting dye image to a dye image receiver.

13. A dye-forming electrothermographic recording process for producing a dye image in a dye-forming electrothermographic element comprising an electrically conductive support bearing at least one dye-forming electrothermographic recording layer (A) and at least one dye-forming electrothermographic layer (B), said process comprising the steps:

(I) applying a first charge exposure to said recording element for a time sufficient to produce a dye-forming image in one of dye-forming electrothermographic layer (A) and (B); then
(II) applying a second charge exposure, which is opposite in polarity to said first charge exposure, to said element for a time sufficient to produce a dye-forming image in the dye-forming electrothermographic layer (A) or (B) not containing a dye-forming image from step (I); and, then
(III) heating said exposed electrothermographic element at a temperature and for a time sufficient to form a dye image in at least one of said layers (A) and (B).

14. In a process of forming a dye image in a dye-forming electrothermographic element comprising at least three electrothermographic layers (A), (B) and (C) capable of forming dye images, the steps comprising (I) imagewise exposing layer (A) to a positive electrical charge for a time sufficient to form a developable image in layer (A) without adversely affecting layers (B) and (C); then
(II) imagewise exposing layer (C) to a negative electrical charge for a time sufficient to form a developable image in layer (C) without adversely affecting layers (A) and (B); then
(III) heating said element at a temperature and for a time sufficient to form dye images in at least said layers (A) and (C).

15. A dye-forming electrothermographic recording process as in claim 10 wherein said multi-layer dye-forming electrothermographic element comprises an electrically conductive support bearing (A) a dye-forming electrothermographic recording layer, capable of forming a yellow dye image, comprising
  (i) a reducing agent or reducing agent precursor capable of being activated by a Lewis base, (ii) a cobalt(III) Lewis base complex, and
(iii) a reducible dye-forming compound that has an oxidation state above that of the conjugate dye, or a dye capable of changing its wavelength of absorption by reaction with a Lewis base to form a yellow dye, or a dye-forming coupler capable of forming a yellow dye upon reaction with the oxidized form of said reducing agent;

(B) a dye-forming electrothermographic layer, capable of forming a magenta dye image, comprising
(i) a reducing agent or reducing agent precursor capable of being activated by a Lewis base,
(ii) a cobalt(III) Lewis base complex, and
(iii) a reducible dye that has an oxidation state above that of the conjugate dye, or a dye capable of changing its wavelength of absorption by reaction with a Lewis base to form a magenta dye, or a dye-forming coupler capable of forming a magenta dye upon reaction with the oxidized form of said reducing agent; and (C) a dye-forming electrothermographic layer, capable of forming a cyan dye image, comprising
(i) a reducing agent or reducing agent precursor capable of being activated by a Lewis base,
(ii) a cobalt(III) Lewis base complex, and
(iii) a reducible dye that has an oxidation state above that of the conjugate dye or a dye capable of changing its wavelength of absorption by reaction with a Lewis base to form a cyan dye, or a dye-forming coupler capable of forming a cyan dye upon reaction with the oxidized form of said reducing agent.

16. A dye-forming electrothermographic process of forming a dye image in a dye-forming electrothermographic element comprising an electrically conductive support bearing on the first side of said support in sequence (A) a first dye-forming electrothermographic layer comprising, in a binder,
(i) a cobalt(III) amine complex,
(ii) a dye-forming coupler (x) capable of oxidiative coupling with the oxidized form of a color developing agent to form a cyan dye, and
(iii) a color developing agent capable in oxidized form of reacting with said coupler (x), (B) a first polymeric acid barrier layer, (C) a second dye-forming electrothermographic layer comprising, in a binder,
(i) a cobalt(III) amine complex,
(ii) a dye-forming coupler (y) capable of oxidative coupling with the oxidized form of a color developing agent to form a magenta dye image, and
(iii) a color developing agent capable in oxidized form of reacting with said coupling (y) to form a magenta dye, (D) a second polymeric acid barrier layer, (E) a third dye-forming electrothermographic layer comprising, in a binder,
(i) a cobalt(III) amine complex,
(ii) a dye-forming coupler (z) capable of oxidative coupling with the oxidized form of a color developing agent to form a yellow dye, and
(iii) a color developing agent capable in oxidized form of reacting with said coupler (z), and (F) an overcoat layer; and on the side opposite of said support opposite to said first side, (G) a fourth dye-forming electrothermographic layer comprising, in a binder,
(i) a cobalt(III) amine complex,
(ii) a dye-forming coupler (q) capable of oxidative coupling with the oxidized form of a color developing agent to form a black dye, and
(iii) a color developing agent capable in oxidized form of reacting with said coupler (q), and (H) an overcoat layer on layer (G);

said process comprising the steps:

(I) imagewise exposing the layers on said first side of said support to an electrical charge of one polarity to form a developable latent image in at least one of layers (A) and (E); then (II) imagewise exposing the layers on said first side of said support to an electrical charge of one polarity opposite of the polarity of step (I) to form a developable latent image in at least one of layers (A) and (E) not comprising a developable latent image from step (I);

(III) imagewise exposing layer (G) to electric charge to form a developable latent image in layer (G); said step (III) being carried out before, during or after steps (I) and (III); and (IV) developing a dye image in the resulting element.

17. A dye-forming electrothermographic element comprising at least two electrothermographic recording layers (A) and (B) capable of forming dye images wherein at least layer (A) is separated from layer (B) by a polymeric acid barrier layer.

18. A dye-forming electrothermographic element comprising an electrically conductive support bearing on the first side of said support, in sequence, (A) a first dye-forming electrothermographic layer comprising, in a binder,
(i) a cobalt(III) amine complex,
(ii) a dye-forming coupler (x) capable of oxidative coupling with the oxidized form of a color developing agent to form a cyan dye, and
(iii) a color developing agent capable in oxidized form of reacting with said coupler (x);

(B) a first polymeric acid barrier layer;

(C) a second dye-forming electrothermographic layer comprising, in a binder,
(i) a cobalt(III) amine complex,
(ii) a dye-forming coupler (y) capable of oxidative coupling with the oxidized form of a color developing agent to form a magenta dye image, and
(iii) a color developing agent capable in oxidized form of reacting with said coupler (y) to form a magenta dye;

(D) a second polymeric acid barrier layer;

(E) a third dye-forming electrothermographic layer comprising, in a binder,
(i) a cobalt(III) amine complex,
(ii) a dye-forming coupler (z) capable of oxidative coupling with the oxidized form of a color developing agent to form a yellow dye, and
(iii) a color developing agent capable in oxidized form of reacting with said coupler (z); and (F) an overcoat layer; and on the side opposite of said support opposite to said first side;

(G) a fourth dye-forming electrothermographic layer comprising, in a binder,
(i) a cobalt(III) amine complex,
(ii) a dye-forming coupler (q) capable of oxidiative coupling with the oxidized form of a color developing agent to form a black dye, and
(iii) a color developing agent capable in oxidized form of reacting with said coupler (q); and (H) an overcoat layer on layer (G).

19. A dye-forming electrothermographic element as in claim 17 wherein said polymeric acid barrier comprises a polymer represented by the formula:

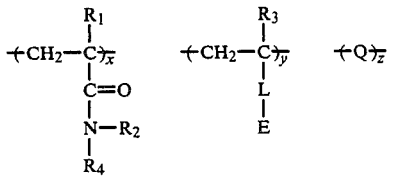

wherein:

$R_1$ and $R_3$ are individually hydrogen or methyl;

$R_2$ and $R_4$ are individually hydrogen or alkyl;

Q represents a recurring unit derived from a monomer having an appended sulfonic acid or sulfonate salt group;

E is an amine-reactive group;

L is a divalent linking group;

x is 0 to 95 weight percent;

y is 3 to 45 weight percent; and z is 0 to 75 weight percent.

20. A dye-forming electrothermographic element as in claim 17 wherein said polymeric acid barrier layers comprise at least one polymer selected from the group consisting of Poly{acrylamide-co-N-[3-(chloroacetamido)propyl]-methacrylamide} (weight ratio 80/20)

Poly{acrylamide-co-N-[3-(2-chloroethylsulfonyl)propionylaminomethyl]acrylamide} (weight ratio 80/20)

Poly(acrylamide-co-acrylic acid) (weight ratio 70/30)

Poly{sodium 2-acrylamido-2-methylpropanesulfonate-co-N-[3-(chloroacetamido)propyl]methacrylamide} (weight ratio 75/25).

* * * * *